US012257525B2

(12) United States Patent
McDonald et al.

(10) Patent No.: US 12,257,525 B2
(45) **Date of Patent: *Mar. 25, 2025**

(54) ASSEMBLY WITH OBJECT IN HOUSING AND MECHANISM TO OPEN HOUSING

(71) Applicant: SPIN MASTER LTD., Toronto (CA)

(72) Inventors: David Lewis McDonald, Mississauga (CA); Anne N. Charbonneau, North York (CA); Hamid R. Hashemi, Mississauga (CA); Victor Lai, Unionville (CA)

(73) Assignee: SPIN MASTER LTD., Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/478,081

(22) Filed: Sep. 29, 2023

(65) Prior Publication Data

US 2024/0024791 A1 Jan. 25, 2024

Related U.S. Application Data

(63) Continuation of application No. 17/816,783, filed on Aug. 2, 2022, now Pat. No. 11,772,002, which is a continuation of application No. 16/947,156, filed on Jul. 21, 2020, now Pat. No. 11,400,386, which is a continuation of application No. 16/364,997, filed on Mar. 26, 2019, now Pat. No. 10,807,011, which is a (Continued)

(51) Int. Cl.

| | |
|---|---|
| ***A63H 3/36*** | (2006.01) |
| ***A63H 3/00*** | (2006.01) |
| ***A63H 3/50*** | (2006.01) |
| ***A63H 13/02*** | (2006.01) |
| ***A63H 29/22*** | (2006.01) |

(52) U.S. Cl.

CPC ..... *A63H 3/36* (2013.01); *A63H 3/006* (2013.01); *A63H 3/008* (2013.01); *A63H 3/50* (2013.01); *A63H 13/02* (2013.01); *A63H 29/22* (2013.01); *A63H 2200/00* (2013.01)

(58) Field of Classification Search

CPC ..... A63H 3/04; A63H 3/006; A63H 3/008; A63H 3/36

USPC ... 446/4, 153, 175, 295, 296, 309–312, 330, 446/336

See application file for complete search history.

(56) References Cited

U.S. PATENT DOCUMENTS 608,794 A * 8/1898 Quinn ..... A63H 13/16 446/385

685,345 A * 10/1901 Perkins ..... A63H 13/16 446/385

(Continued)

OTHER PUBLICATIONS

AU 2023237014 Examination Report dated Oct. 10, 2024.

JP 2024-008473 Notification of Reason(s) for Refusal with English translation dated Nov. 12, 2024.

*Primary Examiner* — Kurt Fernstrom

(74) *Attorney, Agent, or Firm* — Aird & McBurney LP

(57) ABSTRACT

In an aspect, a toy assembly is provided and includes a housing and an inner object inside the housing. The inner object includes a breakout mechanism that includes a hammer and an actuation lever. The hammer is movable between a retracted position in which the hammer is spaced from the housing and an advanced position in which the hammer is positioned to break the housing. The actuation lever is pivotable from a hammer retraction position towards a hammer driving position so as to drive the hammer towards the advanced position.

6 Claims, 37 Drawing Sheets

Related U.S. Application Data continuation of application No. 15/935,280, filed on Mar. 26, 2018, now Pat. No. 10,238,981, which is a continuation of application No. 15/227,740, filed on Aug. 3, 2016, now Pat. No. 9,950,267, which is a continuation-in-part of application No. 15/199,341, filed on Jun. 30, 2016, now abandoned, which is a continuation-in-part of application No. 14/884,191, filed on Oct. 15, 2015, now Pat. No. 9,550,128.

(56) References Cited

U.S. PATENT DOCUMENTS 722,731 A * 3/1903 MacKaye ..... A63H 37/00 446/385
1,237,954 A * 8/1917 Prevost ..... A63H 3/005 446/73
3,005,284 A * 10/1961 Giuliano ..... A63H 37/00 446/5
3,091,053 A * 5/1963 Growald ..... A63H 9/00 446/385
3,139,697 A * 7/1964 Mier ..... A63H 5/04 102/498
3,300,118 A * 1/1967 Owens ..... B65D 3/263 229/4.5
4,071,494 A * 1/1978 Gaylord ..... C08F 255/00 524/451
4,091,929 A * 5/1978 Krane ..... B65D 3/263 426/123
4,194,318 A * 3/1980 Watanabe ..... A63H 17/26 446/296
4,237,648 A * 12/1980 Moe ..... A63H 15/00 463/68
4,259,805 A * 4/1981 Hornsby, Jr. ..... A63H 13/02 446/198
4,317,765 A * 3/1982 Gaylord ..... C08K 9/08 524/427
D276,705 S * 12/1984 Oliveri ..... D10/40
4,575,348 A * 3/1986 Wiggs ..... A63H 13/16 446/330
4,591,345 A * 5/1986 Kohner ..... A63H 3/18 446/361
4,698,043 A * 10/1987 May ..... A63H 33/005 446/273
4,736,943 A * 4/1988 Fukuda ..... A63H 33/00 472/54
4,758,198 A * 7/1988 Ishiwa ..... A63H 3/06 446/224
4,773,541 A * 9/1988 Riddell ..... B65D 71/00 206/391
4,817,936 A * 4/1989 Matsuda ..... A63H 33/005 446/355
4,836,821 A * 6/1989 Raymond ..... A63H 3/008 446/330
4,881,915 A * 11/1989 Liaw ..... A63H 13/02 446/385
D308,938 S * 7/1990 van Erkel ..... D9/603
D312,845 S * 12/1990 Matsuda ..... D21/479
D318,240 S * 7/1991 Pang ..... D10/40
5,120,263 A * 6/1992 Lerfino ..... A63H 13/16 273/459
5,263,889 A * 11/1993 Ledonne ..... A63H 33/00 446/75
5,451,180 A * 9/1995 Chan ..... A63H 13/00 40/411
5,522,758 A * 6/1996 Liu ..... A63H 13/00 40/411
5,795,209 A * 8/1998 Moore ..... A63H 37/00 446/485
5,813,895 A * 9/1998 Cho ..... G09B 23/36 446/385
D406,053 S * 2/1999 Ying ..... D9/603
5,989,092 A * 11/1999 McGowan ..... A63H 33/003 446/175
6,171,166 B1 * 1/2001 Oquita ..... A63F 11/0011 446/73
6,210,250 B1 * 4/2001 Sui ..... G09F 19/02 446/330
D442,650 S * 5/2001 Allen ..... D21/595
6,231,346 B1 * 5/2001 Sagi-Dolev ..... G09B 23/00 446/73
6,250,985 B1 * 6/2001 Nicholson ..... A63H 37/00 446/368
6,312,308 B1 * 11/2001 Chen ..... A63H 33/00 428/3
D478,134 S * 8/2003 Yuan ..... D21/615
6,648,713 B1 * 11/2003 Oquita ..... A63H 37/00 446/73
6,702,644 B1 * 3/2004 Hornsby ..... A63H 3/008 446/268
6,761,612 B1 * 7/2004 Pencil ..... A63H 37/005 446/76
D532,463 S * 11/2006 Boutin ..... A47D 13/086 D21/609
8,684,224 B2 * 4/2014 House ..... B65D 3/265 229/206
8,974,264 B2 * 3/2015 McCafferty ..... A63H 13/16 446/430
D789,241 S * 6/2017 Cao ..... D11/121
9,720,378 B2 * 8/2017 Hills ..... G04F 1/00
9,724,616 B1 * 8/2017 Pedersen ..... A63H 27/10
D801,621 S * 11/2017 Ensslen ..... D1/110
10,398,994 B1 * 9/2019 Cumings ..... A63H 3/50
D1,022,347 S * 4/2024 Li ..... D30/160
2001/0034178 A1 * 10/2001 Spector ..... A63H 33/00 446/385
2002/0098770 A1 * 7/2002 Mesch ..... A63H 13/16 446/310
2004/0127140 A1 * 7/2004 Kelly ..... A63H 3/36 446/268
2005/0075041 A1 * 4/2005 Norman ..... A63H 3/18 446/310
2006/0030236 A1 * 2/2006 Ueno ..... A63H 13/16 446/310
2007/0049162 A1 * 3/2007 Liao ..... A63H 29/22 446/487
2007/0102308 A1 * 5/2007 Tremblay ..... B65D 11/04 206/223
2007/0173170 A1 * 7/2007 Wu ..... A63H 33/003 446/153
2008/0014831 A1 * 1/2008 Rettberg ..... A63H 3/365 446/297
2020/0016505 A1 * 1/2020 Adler ..... A63H 33/001
2020/0261814 A1 * 8/2020 Pruzansky ..... A63H 3/46

* cited by examiner

ASSEMBLY WITH OBJECT IN HOUSING AND MECHANISM TO OPEN HOUSING

CROSS-REFERENCE TO RELATED APPLICATIONS

This application is a continuation of and claims the benefit of U.S. patent application Ser. No. 17/816,783 filed Aug. 2, 2022; continuation of and claims the benefit of U.S. patent application Ser. No. 16/947,156 filed Jul. 21, 2020, now granted as U.S. patent Ser. No. 11/400,386 which is a Continuation of U.S. patent application Ser. No. 16/364,997, filed on Mar. 26, 2019, now granted as U.S. patent Ser. No. 10/807,011 which is a Continuation of U.S. patent application Ser. No. 15/935,280 filed Mar. 26, 2018, now granted as U.S. patent Ser. No. 10/238,981 which is a Continuation of U.S. patent application Ser. No. 15/227,740 filed Aug. 3, 2016, now granted as U.S. Pat. No. 9,950,267 which is a Continuation-in-Part application of U.S. patent application Ser. No. 15/199,341 filed Jun. 30, 2016, which is a Continuation-in-Part application of U.S. patent application Ser. No. 14/884,191 filed Oct. 15, 2015, now granted as U.S. Pat. No. 9,550,128, the contents of all of which are incorporated herein by reference in their entirety.

FIELD

The specification relates generally to assemblies with inner objects inside housings, and more particularly to a toy character in a housing shaped like an egg.

BACKGROUND OF THE DISCLOSURE

There is a continuing desire to provide toys that interact with a user, and for the toys to reward the user based on the interaction. For example, some robotic pets will show simulated love if their owner pats their head several times. While such robotic pets are enjoyed by their owners, there is a continuing desire for new and innovative types of toys and particularly toy characters that interact with their owner.

SUMMARY OF THE DISCLOSURE

In an aspect, a toy assembly is provided, and includes a housing, an inner object (which may, in some embodiments, be a toy character), at least one sensor and a controller. The inner object is positioned inside the housing and includes a breakout mechanism that is operable to break the housing to expose the inner object. The at least one sensor detects interaction with a user. The controller is configured to determine whether a selected condition has been met based on at least one interaction with the user, and to operate the breakout mechanism to break the housing to expose the inner object if the condition is met. Optionally, the condition is met based upon having a selected number of interactions with the user.

According to another aspect, a method is provided for managing an interaction between a user and a toy assembly, wherein the toy assembly includes a housing and a toy character inside the housing. The method includes:

a) receiving from the user a registration of the toy assembly;

b) receiving from the user after step a), a first progress scan of the toy assembly;

c) displaying a first output image of the toy character in a first stage of virtual development;

d) receiving from the user after step c), a second progress scan of the toy assembly; and e) displaying a second output image of the inner object in a second stage of virtual development that is different than the first output image.

In another aspect, a toy assembly is provided. The toy assembly includes a housing, an inner object (which may, in some embodiments, be a toy character) inside the housing, a breakout mechanism that is associated with the housing and that is operable to break the housing to expose the inner object. The breakout mechanism is powered by a breakout mechanism power source that is associated with the housing. Optionally, the breakout mechanism is inside the housing. As a further option, the breakout mechanism may be operable from outside the housing. Optionally, the breakout mechanism includes a hammer, positioned in association with the inner object, wherein the breakout mechanism power source is operatively connected to the hammer to drive the hammer to break the housing. Optionally, the breakout mechanism power source is operatively connected to the hammer to reciprocate the hammer to break the housing.

In another aspect, a toy assembly is provided, and includes a housing and a inner object (which may, in some embodiments, be a toy character) inside the housing, wherein the housing has a plurality of irregular fracture paths formed therein, such that the housing is configured to fracture along at least one of the fracture paths when subjected to a sufficient force.

In another aspect, a toy assembly is provided, and includes a housing and a inner object (which may, in some embodiments, be a toy character) inside the housing in a pre-breakout position. The inner object includes a functional mechanism set. The inner object is removable from the housing and is positionable in a post-breakout position. When the inner object is in the pre-breakout position, the functional mechanism set is operable to perform a first set of movements. When the inner object is in the post-breakout position, the functional mechanism set is operable to perform a second set of movements that is different than the first set of movements. In an example, the inner object further includes, a breakout mechanism, a breakout mechanism power source, at least one limb and a limb power source that all together form part of the functional mechanism set. When the inner object is in the pre-breakout position, the limb power source is operatively disconnected from the at least one limb, and so movement of the limb power source does not drive movement of the at least one limb. However, in the pre-breakout position, the breakout mechanism power source drives movement of the breakout mechanism so as to break the housing and expose the inner object. When the inner object is in the post-breakout position the limb power source is operatively connected to the at least one limb and can drive movement of the limb, but the breakout mechanism is not driven by the breakout mechanism power source.

In another aspect, a polymer composition is provided, the polymer composition including about 15-25 weight-% base polymer; about 1-5 weight-% organic acid metal salt; and about 75-85 weight-% inorganic/particulate filler.

In another aspect, an article of manufacture is provided, the article of manufacture formed of the polymer composition including about 15-25 weight-% base polymer; about 1-5 weight-% organic acid metal salt; and about 75-85 weight-% inorganic/particulate filler.

In another aspect, a toy assembly is provided and includes a housing, and a inner object (which may, in some embodiments, be a toy character) inside the housing, wherein the inner object includes a breakout mechanism that is operable to break the housing to expose the inner object, and wherein the housing includes a plurality of fracture elements provided on an inside face thereof to facilitate fracture upon impact from the breakout mechanism.

In another aspect, a housing fracturing mechanism is provided, and includes a first frame member, a second frame member rotatably coupled to the first frame member, an aperture in which a housing to be broken is positioned, and at least one cutting element pivotally coupled to the first frame member and slidably coupled to the second member that is pivoted between a first position in which the at least one cutting element is adjacent the housing when placed in the aperture and a second position in which the at least one cutting element intersects the housing when placed in the aperture.

In still yet another aspect, a toy assembly is provided, comprising a housing, an inner object inside the housing, and a breakout mechanism that is associated with the housing and that is operable to break the housing to expose the inner object, wherein the breakout mechanism exhibits an additional behavior when placed back into the housing.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1A:
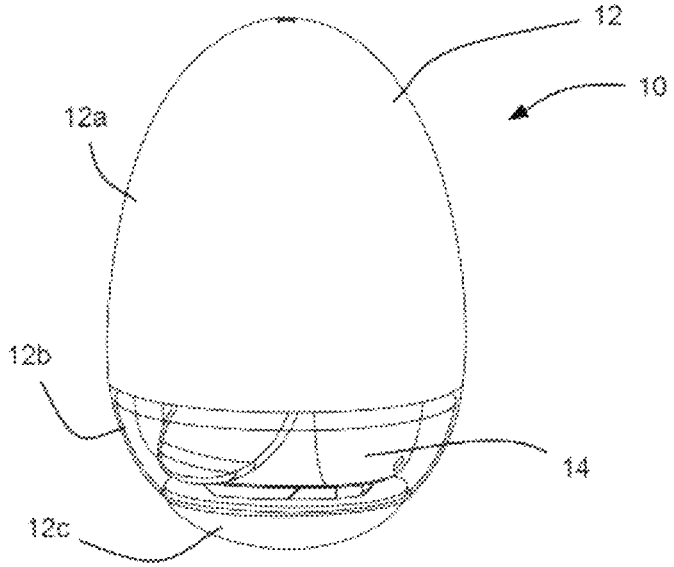
FIGS. 1A and 1B are transparent side view of a toy assembly according to a non-limiting embodiment.
Figure 1B:
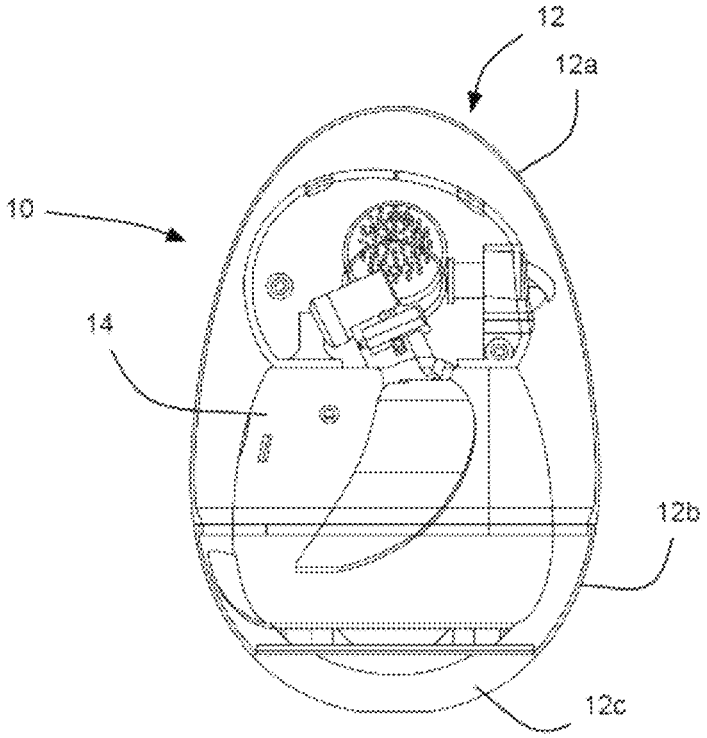

Reference is made to FIGS. 1A and 1B, which show a toy assembly 10 in accordance with an embodiment of the present disclosure. The toy assembly 10 includes a housing 12 and a toy character 14 that is positioned in the housing 12. For the purposes of showing the toy character 14 inside the housing 12, parts of the housing 12 are shown as transparent in FIGS. 1A and 1B, however the housing 12 may, in the physical assembly, be opaque in the sense that, under typical ambient lighting conditions, the toy character 14 would be not visible to a user through the housing 12. In the embodiment shown, the housing 12 is in the form of an egg shell and the toy character 14 inside the housing 12 is in the form of a bird. However, the housing 12 and toy character 14 may have any other suitable shapes. For manufacturing purposes, the housing 12 may be formed from a plurality of housing members, individual shown as a first housing member 12*a*, a second housing member 12*b* and a third housing member 12*c*, which are fixedly joined together so as to substantially enclose the toy character 14. In some embodiments the housing 12 could alternatively only partially enclose the toy character 14 so that the toy character could be visible from some angles even when it is inside the housing 12.

The toy character 14 is configured to break the housing 12 from within the housing 12, as to expose the toy character 14. In embodiments in which the housing 12 is in the form of an egg, the act of breaking the housing 12 will appear to the user as if the toy character 14 is hatching from the egg, particular in embodiments in which the toy character 14 is in the form of a bird, or some other animal that normally hatches from an egg, such as a turtle, a lizard, a dinosaur, or some other animal.

Figure 2:
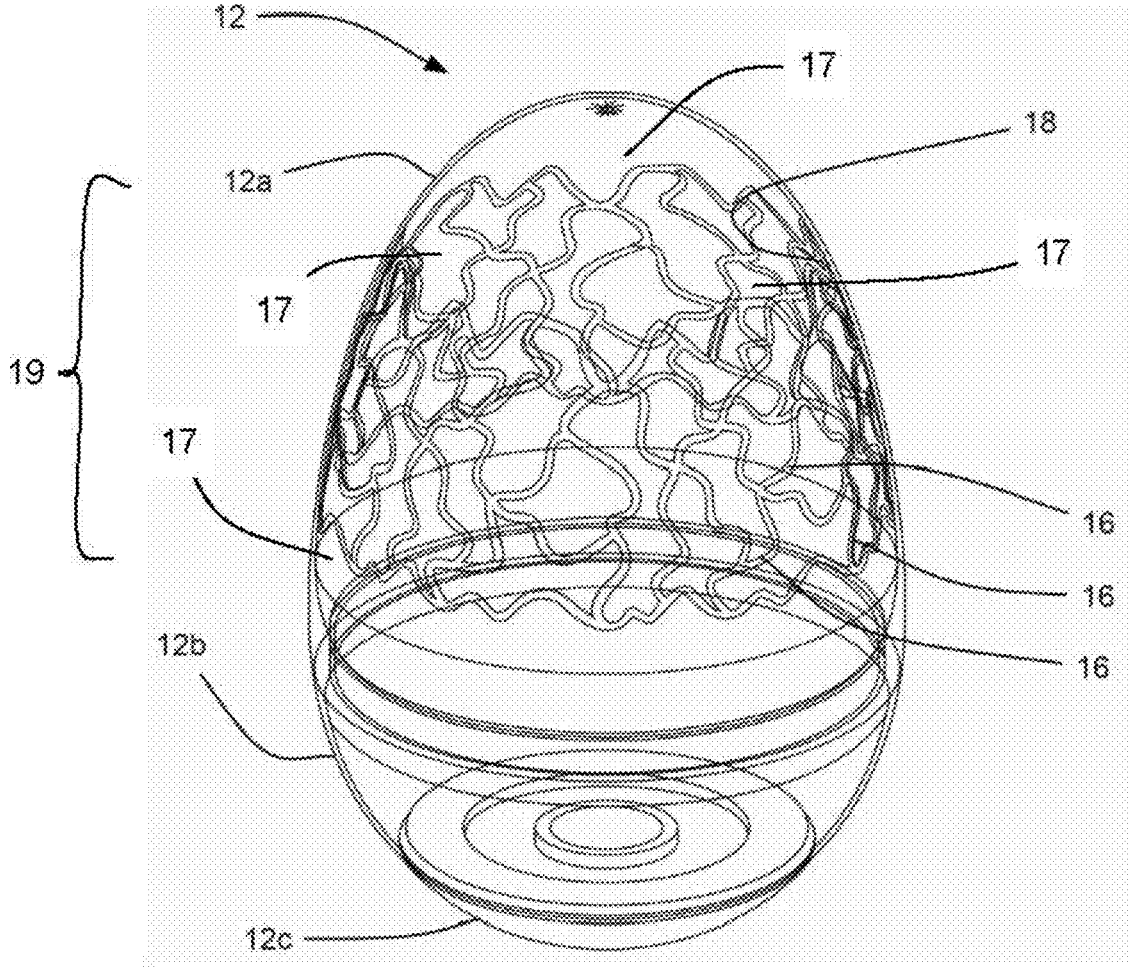
FIG. 2 is a transparent, perspective view of a housing that is part of the toy assembly shown in FIGS. 1A and 1B.

Referring to the transparent view in FIG. 2, the housing 12 may include a plurality of irregular fracture paths 16 formed therein. As a result, when the toy character 14 breaks the housing 14 it appears to the user that the housing 12 has been broken randomly by the toy character 14, to impart realism to the process of breaking the housing. The irregular fracture paths 16 may have any suitable shape. For example, the fracture paths 16 may be generally arcuate, so as to inhibit the presence of sharp corners in the housing 12 during breakage of the housing 12 by the toy character 14. The irregular fracture paths 16 may be formed in any suitable way. For example, the fracture paths may be molded directly into one or more of the housing members 12*a*-12*c*. In the example shown, the fracture paths 16 are provided on the inside face (shown at 18) of the housing 12 so as to not be visible to the user prior to breakage of the housing 12. As a result of the fracture paths 16, the housing 12 is configured to fracture along at least one of the fracture paths 16 when subjected to a sufficient force.

The housing 12 may be formed of any suitable natural or synthetic polymer composition, depending on the desired performance (i.e., breakage) properties. When presented in the form of an egg shell, as shown for example in FIG. 1A, the polymer composition may be selected so as to exhibit a realistic breakage behavior upon impact from the breakout mechanism 22 of the toy character 14. In general, suitable materials for a simulated breakable egg shell may exhibit one or more of low elasticity, low plasticity, low ductility and low tensile strength. Upon action by the breakout mechanism 22, the material should fracture, without significant absorption of the impact force. In other words, upon impact by the breakout mechanism 22, the material should not significantly flex, but rather fracture along one or more of the defined fracture elements. In addition, the polymer composition may be selected to demonstrate breakage without the formation of sharp edges. During the breakage event, the selected polymer composition should enable broken and loosened pieces to separate and fall cleanly away from the housing 12, with minimal unrealistic hanging due to flex or bending at undetached points.

It has been determined that polymer compositions having high filler content relative to the base polymer exhibit performance properties desired for simulating a breaking egg shell. An exemplary composition having high filler content may comprise about 15-25 weight-% base polymer, about 1-5 weight-% organic acid metal salt and about 75-85 weight-% inorganic/particulate filler. It will be appreciated that a variety of base polymers, organic acid metal salts and fillers may be selected to achieve the desired performance properties. In one exemplary embodiment suitable for use in forming the housing 12, the composition is comprised of 15-25 weight-% ethylene-vinyl acetate, 1-5 weight-% zinc stearate and 75-85 weight-% calcium carbonate.

While exemplified using ethylene-vinyl acetate, it will be appreciated that a variety of base polymers may be used depending on the desired performance properties. Alternatives for the base polymer may include select thermoplastics, thermosets and elastomers. For example, in some embodiments, the base polymer may be a polyolefin (i.e., polypropylene, polyethylene). It will be further appreciated that the base polymer may be selected from a range of natural polymers used to produce bioplastics. Exemplary natural polymers include, but are not limited to, starch, cellulose and aliphatic polyesters.

While exemplified using calcium carbonate, it will be appreciated that an alternative particulate filler may be suitably used. Exemplary alternatives may include, but are not limited to, talc, mica, kaolin, wollastonite, feldspar, and aluminum hydroxide.

With reference to FIG. 2, where the housing 12 is provided in the form of an egg shell, the wall thickness in structural regions 17, that is on portions of the housing 12 surrounding the fracture elements (shown in FIG. 2 as fracture paths 16) may be in the range of 0.5 to 1.0 mm. The selected wall thickness may take into account a number of factors, including ease of molding (i.e., injection molding), in particular with respect to melt flow performance through the mold tool for a selected polymer composition. For the exemplary polymer composition noted above, that is the composition comprised of 15-25 weight-% ethylene-vinyl acetate, 1-5 weight-% zinc stearate and 75-85 weight-% calcium carbonate, a wall thickness of 0.7 to 0.8 mm for the structural regions 17 may be selected to achieve good molding performance. With this composition, a thickness of 0.7 to 0.8 mm for the structural region 17 has also been found to provide sufficient strength to maintain the integrity of the housing 12 during transport and handling, particularly when being handled by children.

The arrangement of the plurality of fracture paths 16 formed on the inside face 18 of the housing 12 serves to facilitate the process of breaking the housing 12 by the breakout mechanism 22. In a housing 12 provided in the form of a breakable egg shell, the fracture paths 16 are generally provided in a breakage zone 19 of the first housing member 12*a*. It will be appreciated, however, that the breakage zone 19 may be provided in one or more of the various housing members 12*a*, 12*b*, 12*c*. The fracture paths 16 may be formed in either a random or regular (i.e., geometric) pattern, depending on the desired breakage behavior. Turning to FIGS. 15 to 19B, shown are a number of exemplary fracture elements that may be formed into the housing 12.

Figure 15:
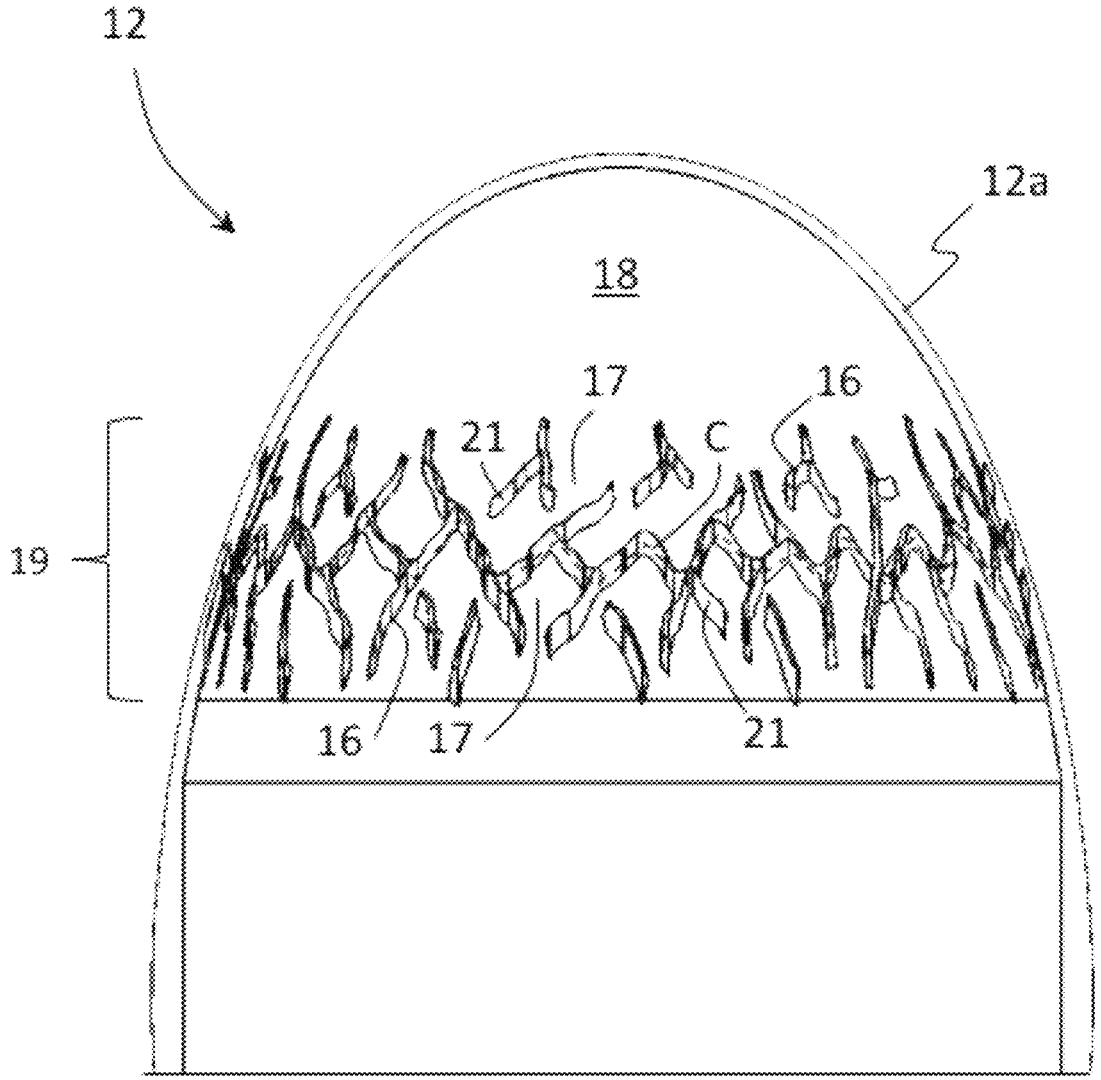
FIG. 15 is a schematic side view of a housing presented in the form of an egg shell having a combination of continuous and discontinuous fracture paths formed therein.

FIG. 15 shows an embodiment where the fracture elements are presented as fracture paths 16 in the breakage zone 19, the fracture paths 16 including a combination of continuous (i.e., interconnected) and discontinuous (i.e., dead-end) channels 21 formed on the inside face 18 of the housing 12. To facilitate breakage, the channels 21 are positioned so as to provide a generally continuous centrally-located fracture path (shown at dotted line C) through the breakage zone 19. The fracture paths 16 define a region of reduced wall thickness, generally 40 to 60% thinner in comparison to the wall thickness of the structural regions 17. In some embodiments, the fracture paths 16 are dimensioned to present a wall thickness that is 50% thinner than the wall thickness of the surrounding structural region 17. Accordingly, where a housing 12 is provided having a wall thickness of 0.8 mm in the structural region 17, the fracture paths 16 will generally exhibit a wall thickness of 0.4 mm. As shown, the width of the channels 21 vary between 0.5 to 1.5 mm along the length thereof, with some channels exhibiting a generally decreasing width towards the terminal (i.e., dead-end) regions thereof.

Figure 16:
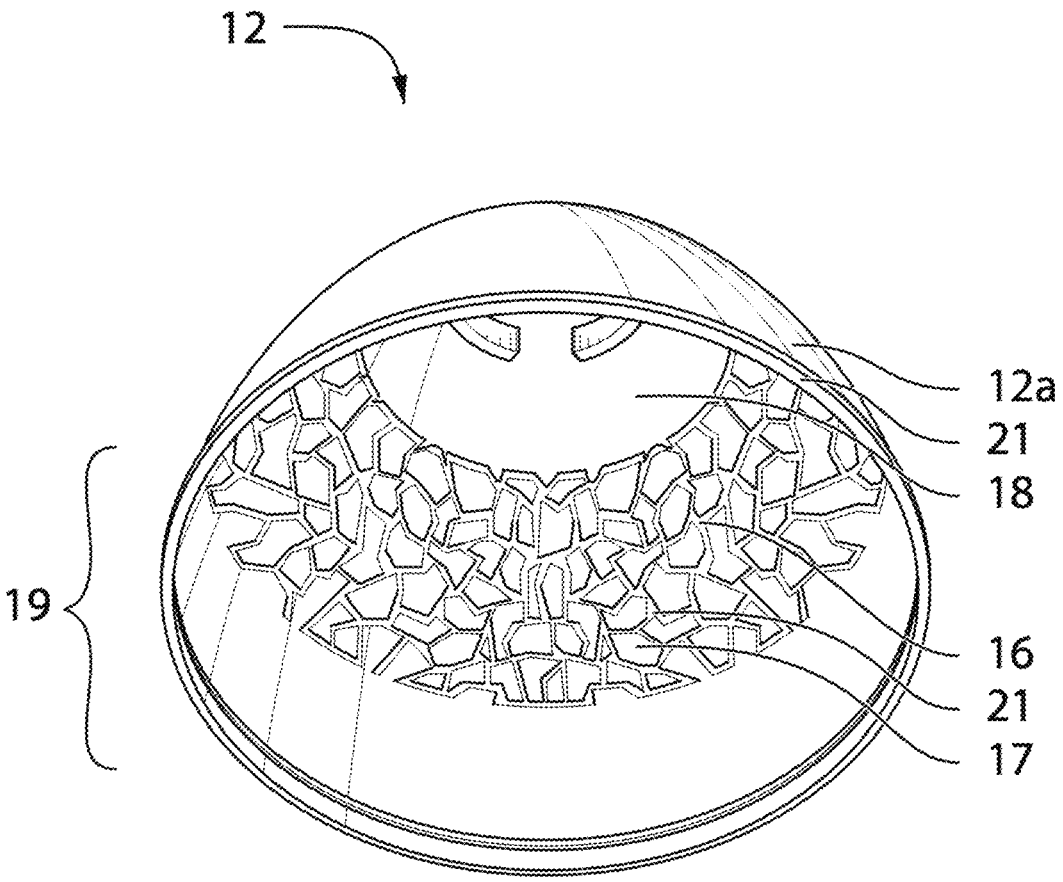
FIG. 16 is a perspective view of a housing presented in the form of an egg shell having a plurality of continuous fracture paths arranged in a random pattern.

FIG. 16 shows an embodiment where the fracture elements are presented as fracture paths 16 in the breakage zone 19, the fracture paths 16 being randomly positioned, and where the channels 21 forming the fracture paths 16 are continuous (i.e., interconnected) therethrough. Similar to the embodiment of FIG. 15, the fracture paths 16 in FIG. 15 define a region of reduced wall thickness, generally 40 to 60% thinner in comparison to the wall thickness of the structural regions 17. In some embodiments, the fracture paths 16 are dimensioned to present a wall thickness that is 50% thinner than the wall thickness of the surrounding structural region 17. Accordingly, where a housing 12 is provided having a wall thickness of 0.8 mm in the structural region 17, the fracture paths 16 will generally exhibit a wall thickness of 0.4 mm. Although the width of the channels 21 may vary, in particular at regions where two or more channels intersect, the channels are formed having a width generally in the range of 0.8 to 1.2 mm.

Figure 17A:
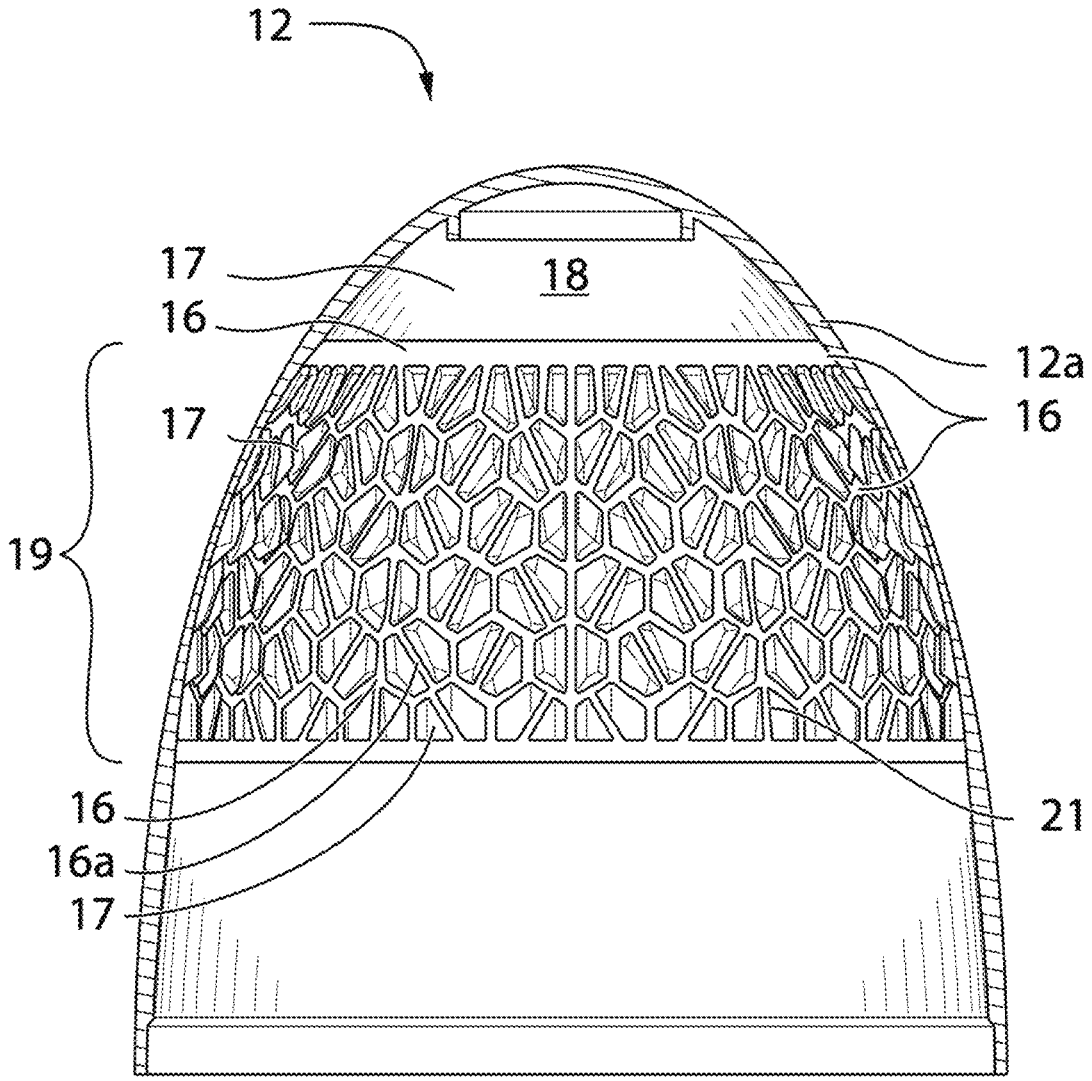
FIG. 17A is a schematic side view of a housing presented in the form of an egg shell having a plurality of continuous fracture paths arranged in a geometric pattern.
Figure 17B:
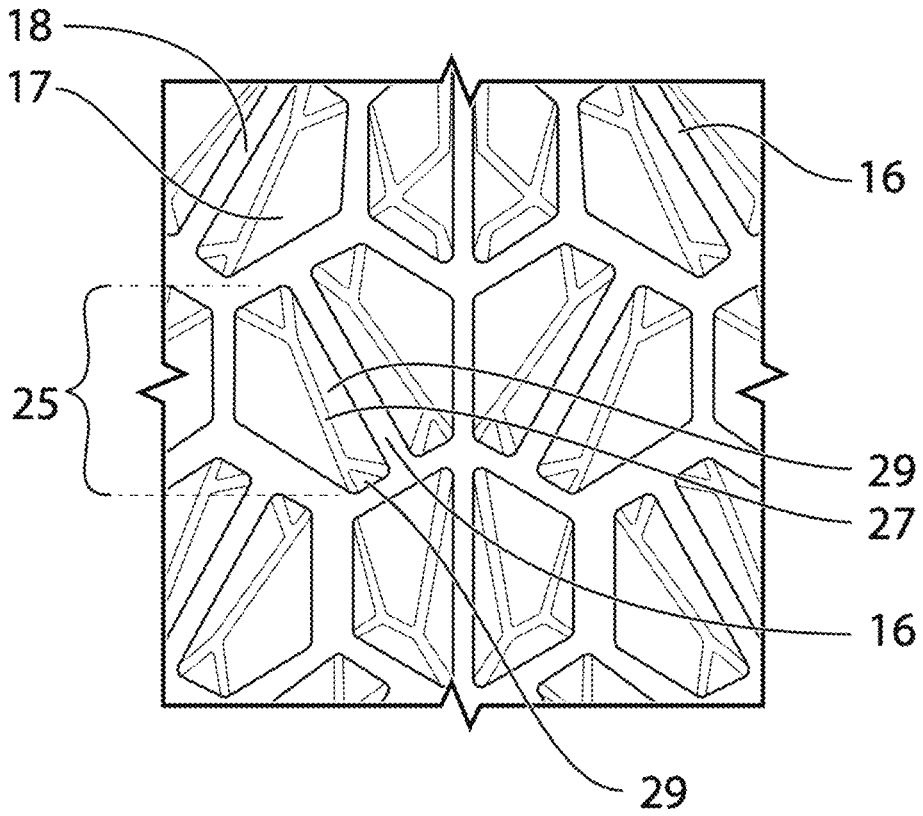
FIG. 17B is a perspective view of the housing of FIG. 17A, showing in greater detail the geometric pattern of the fracture paths.

FIG. 17A shows an embodiment where the fracture elements are presented as fracture paths 16 in the breakage zone 19, the fracture paths 16 being arranged in a geometric pattern, and where the channels 21 forming the fracture path 16 are continuous (i.e., interconnected) therethrough. As shown, the geometric pattern includes a plurality of hexagons arranged in a grid, where the perimeter (i.e., sides) of the hexagons define the fracture path 16. Each hexagon is further provided with a central fracture path 16*a* bisecting the hexagon, either through opposing vertices, or opposing sides. Similar to the embodiment of FIG. 15, the fracture paths 16/16*a* in FIG. 17A define a region of reduced wall thickness, generally 40 to 60% thinner in comparison to the wall thickness of the structural regions 17. In some embodiments, the fracture paths 16/16*a* are dimensioned to present a wall thickness that is 50% thinner than the wall thickness of the surrounding structural region 17. Accordingly, where a housing 12 is provided having a wall thickness of 0.8 mm in the structural region 17, the fracture paths 16/16*a* will generally exhibit a wall thickness of 0.4 mm. Within each geometric shape, the area delimited by the surrounding fracture paths 16 may be formed with uniform wall thickness. In an alternative arrangement, the region 25 delimited by the surrounding fracture paths 16 may be tapered as shown in FIG. 17*b*. As shown, each region 25 includes a central ridge 27 having a first thickness (i.e., similar to or greater than the thickness of the structural region 17) and a plurality of tapered walls 29 extending from the central ridge 27 in the direction towards an adjacent fracture paths 16. In comparison to the embodiments of FIGS. 15 and 16, the width of the channels 21 is more uniform where the fracture paths 16 are arranged in a geometric pattern. Although the width of the channels may vary, the channels in some embodiments may be formed having a width of approximately 0.8 mm.

Figure 18:
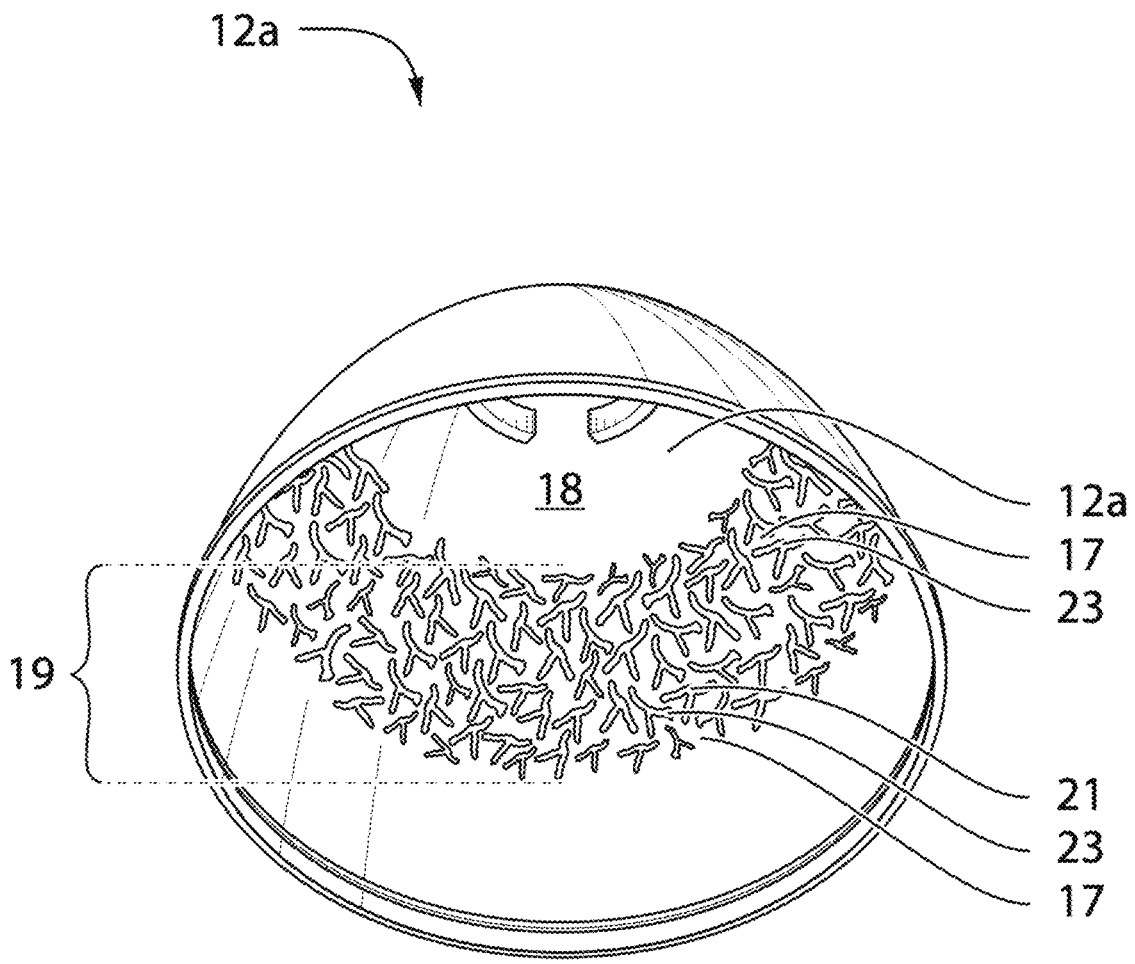
FIG. 18 is perspective view of a housing presented in the form of an egg shell having a plurality of discontinuous fracture paths arranged in a random pattern.

FIG. 18 illustrates an embodiment where the breakage zone 19 includes a series closely associated but discontinuous and randomly positioned fracture elements (shown as fracture units 23). Each fracture unit 23 generally presents in the form of a T- or Y-shaped channel, having a width of 0.5 to 1.5 mm. The fracture unit 23 defines a region of reduced wall thickness, generally in the region of 40 to 60% compared to the wall thickness of the structural regions 17. In some embodiments, the fracture units 23 are dimensioned to present a wall thickness that is 50% thinner than the wall thickness of the surrounding structural region 17. Accordingly, where a housing 12 is provided having a wall thickness of 0.8 mm in the structural region 17, the fracture units 23 will generally exhibit a wall thickness of 0.4 mm.

Figure 19A:
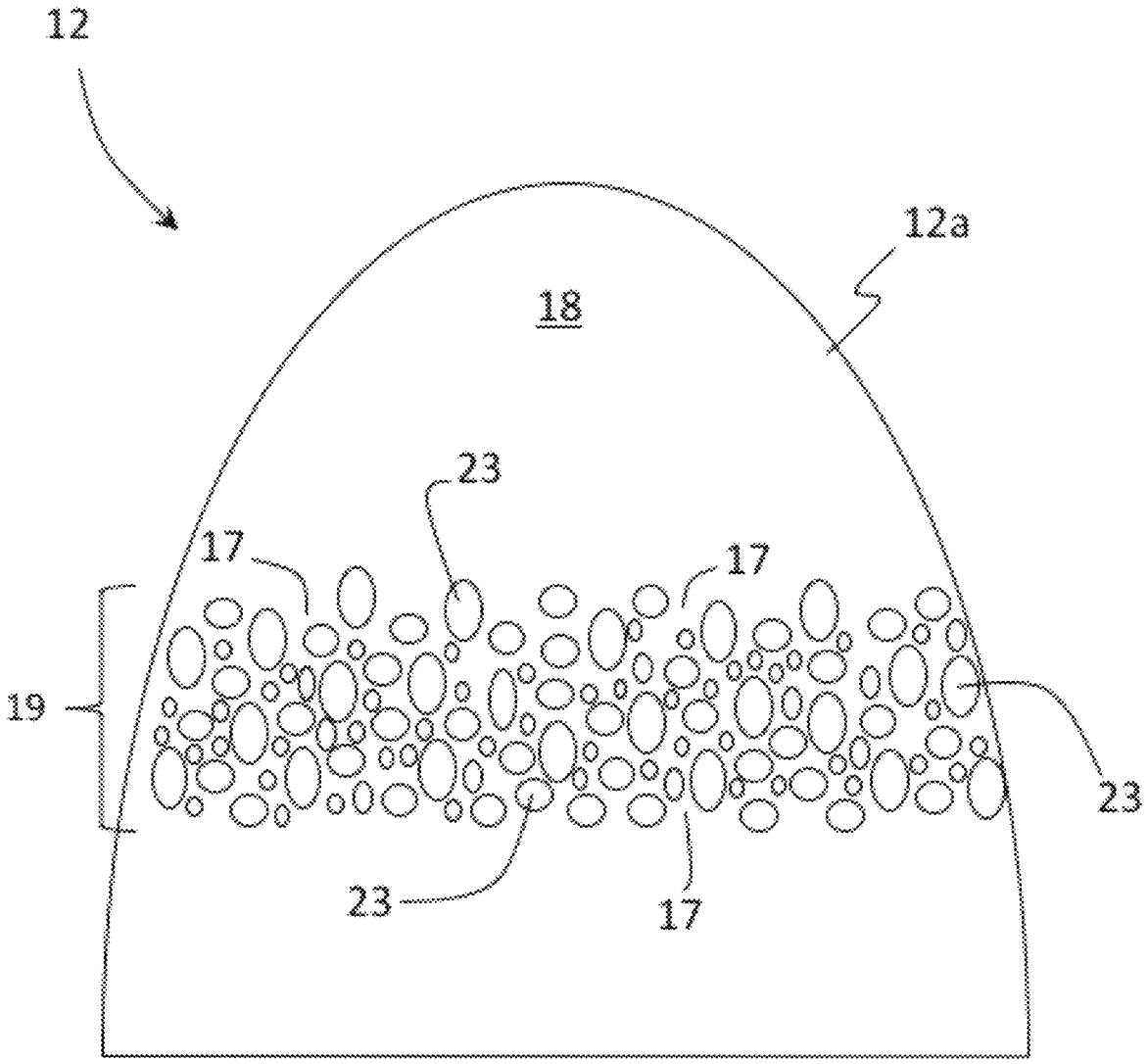
FIG. 19A is a schematic side view of a housing presented in the form of an egg shell having a plurality of fracture units arranged in a random pattern.
Figure 19B:
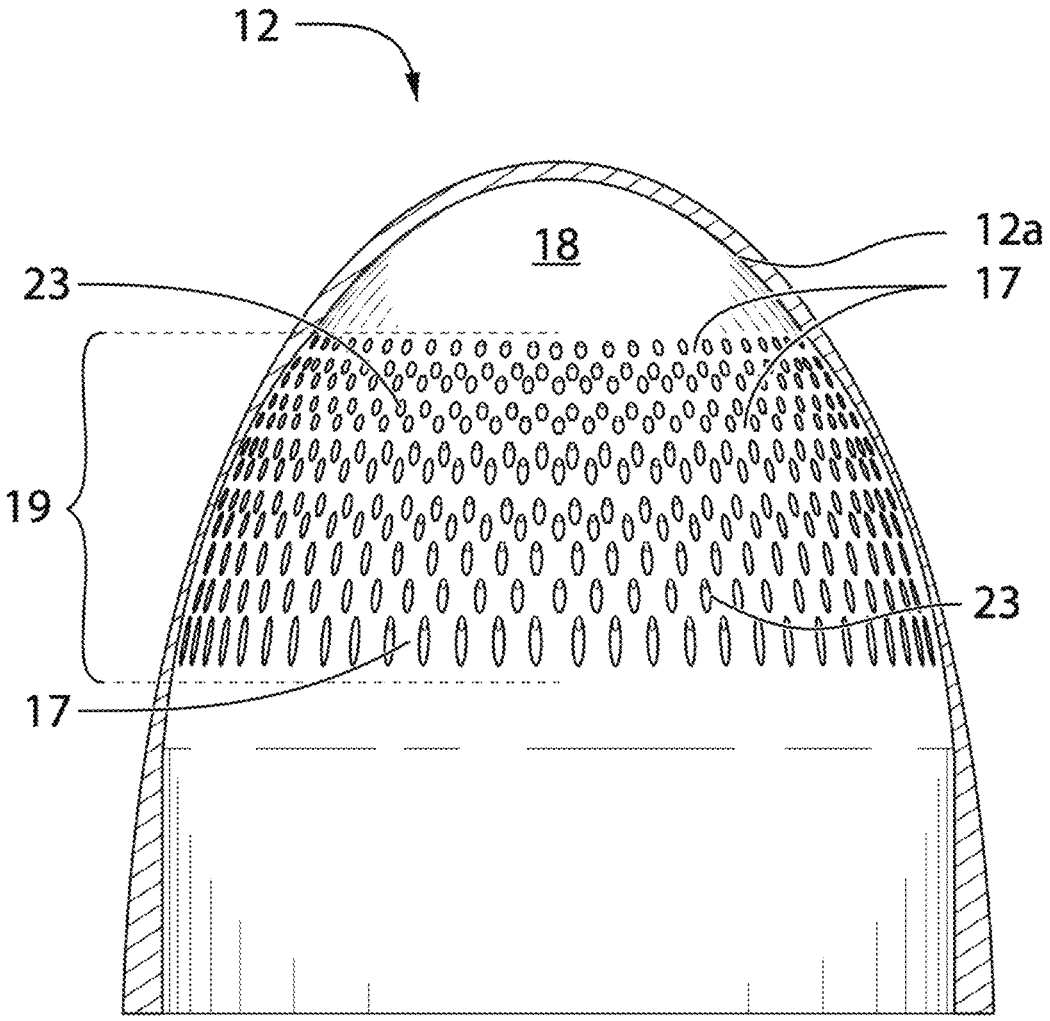
FIG. 19B is a perspective view of a housing presented in the form of an egg shell having a plurality of fracture units arranged in a regular repeating pattern.

With reference to FIGS. 19A and 19B, shown are additional alternative embodiments where a discontinuous array of fracture elements is provided to establish the breakage zone 19. FIGS. 19A and 19B present a plurality of fracture elements (shown as fracture units 23) in the form of a circular and/or oval depressions formed in the housing 12. The circular and/or oval fracture units 23 may be provided in various sizes and orientations, to achieve a generally random breakage behavior. In addition, the fracture units 23 may be arranged in a generally random pattern, as shown in FIG. 19A, or in a regular repeating pattern as shown in FIG. 19B. The fracture units 23 in FIGS. 19A and 19B define a region of reduced wall thickness, generally 40 to 60% thinner in comparison to the wall thickness of the structural regions 17. In some embodiments, the fracture units 23 are dimensioned to present a wall thickness that is 50% thinner than the wall thickness of the surrounding structural region 17. Accordingly, where a housing 12 is provided having a wall thickness of 0.8 mm in the structural region 17, the fracture units 23 will generally exhibit a wall thickness of 0.4 mm.

The fracture elements (fracture paths 16/fracture units 23) may account for 20 to 80% of the area within the breakage zone 19. In some embodiments where the housing is required to fracture at a higher impact force, the fracture paths/units may account for 20 to 30% of the area within the breakage zone 19. Conversely, where the housing 12 is required to fracture at a lower impact force, the fracture elements may account for 70% to 80% of the area within the breakage zone 19. In the embodiments shown in Figures through 19B, the fracture elements account for approximately 40 to 60% of the area within the breakage zone. Selection the proportion of fracture elements relative to the structural region of the housing 12 will consider a number of factors, including, but not limited to, the materials used, the forces required to fracture the housing, as well as the shape of the housing. For example, in an embodiment where the polymer composition incorporates a base polymer having higher strength characteristics compared to ethylene-vinyl acetate, the housing may require a higher proportion of fracture elements (i.e., 70% to 80%) to achieve housing fracture under the same impact conditions. It will be appreciated that other embodiments may incorporate a proportion of fracture elements that may be less than 20%, or greater than 80%, depending on the intended application and the impact forces used to achieve housing fracture.

Although the housing 12 has been exemplified in the form of an egg shell, it will be appreciated that the materials and molding features discussed above may be applied to other articles of manufacture, including but not limited to other housing configurations as well as consumer packaging. For example, where the toy character is provided in the form of an action figure, the housing may be provided in the form of a building, with the action figure being configured to impact the housing from the inside upon being activated. It will be appreciated that a multitude of toy/housing combinations may be possible.

Figure 3:
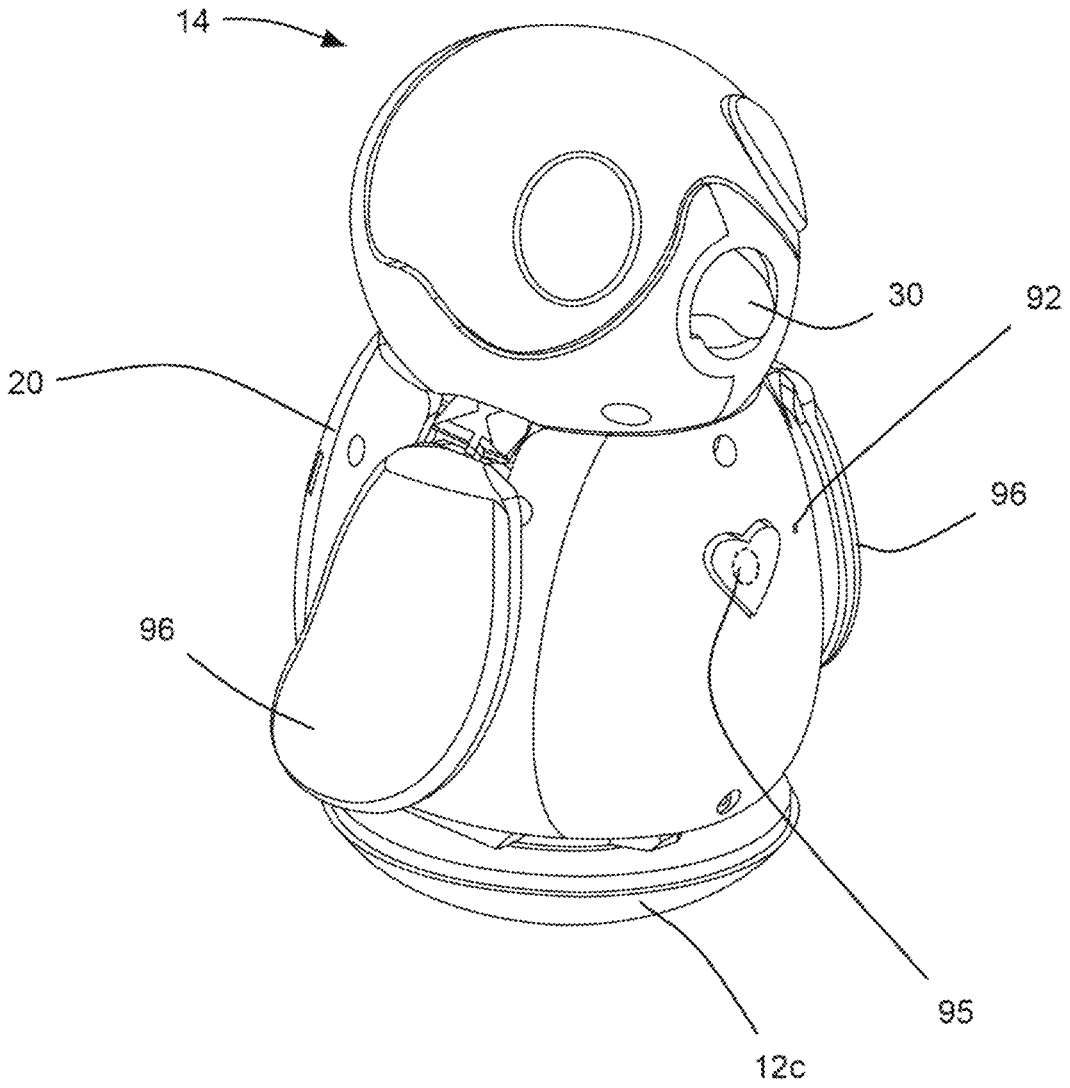
FIG. 3 is a perspective view of a toy character that is part of the toy assembly shown in FIGS. 1A and 1B.
Figure 4:
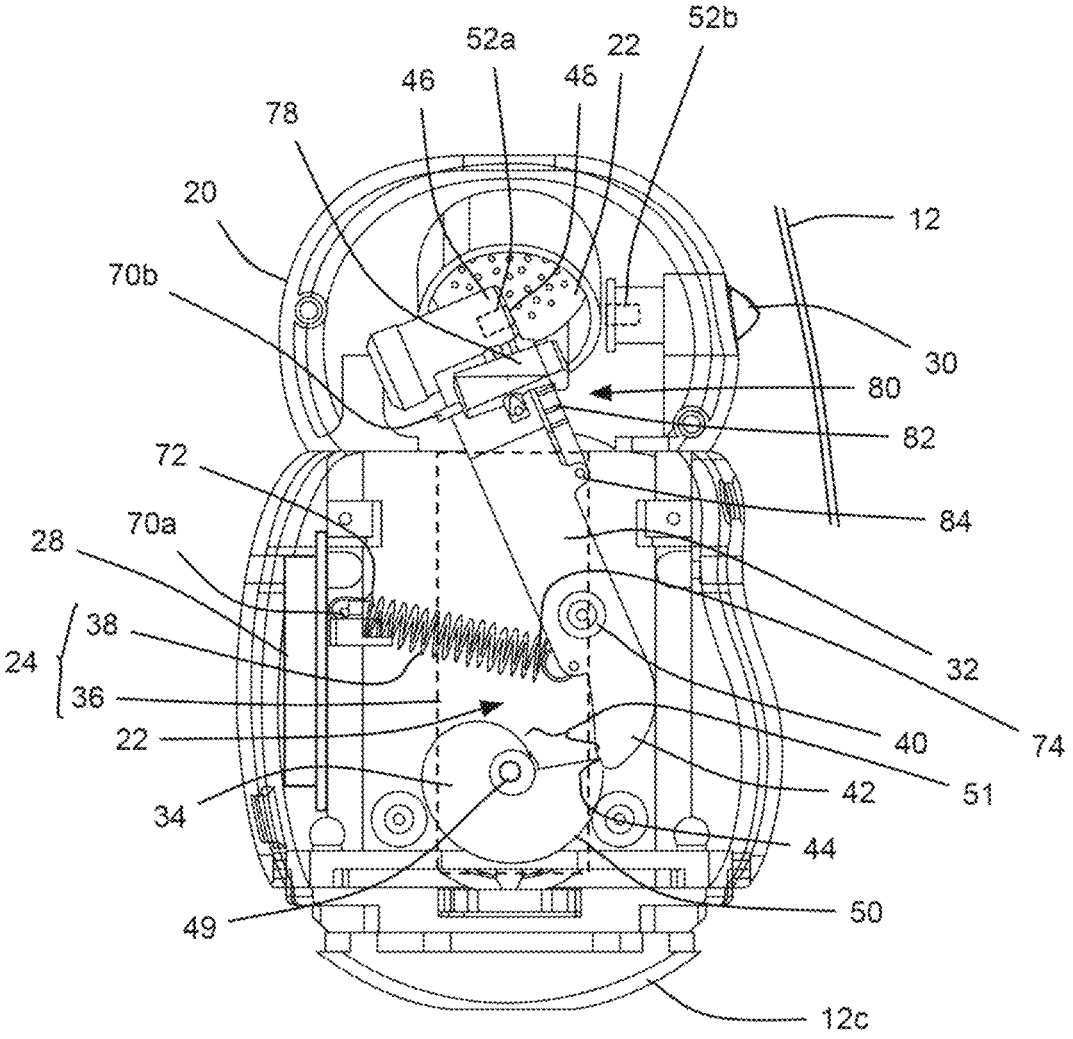
FIG. 4 is a sectional side view of the toy character shown in FIG. 2, in a pre-breakout position, prior to engagement of a hammer that is part of a breakout mechanism.
Figure 5:
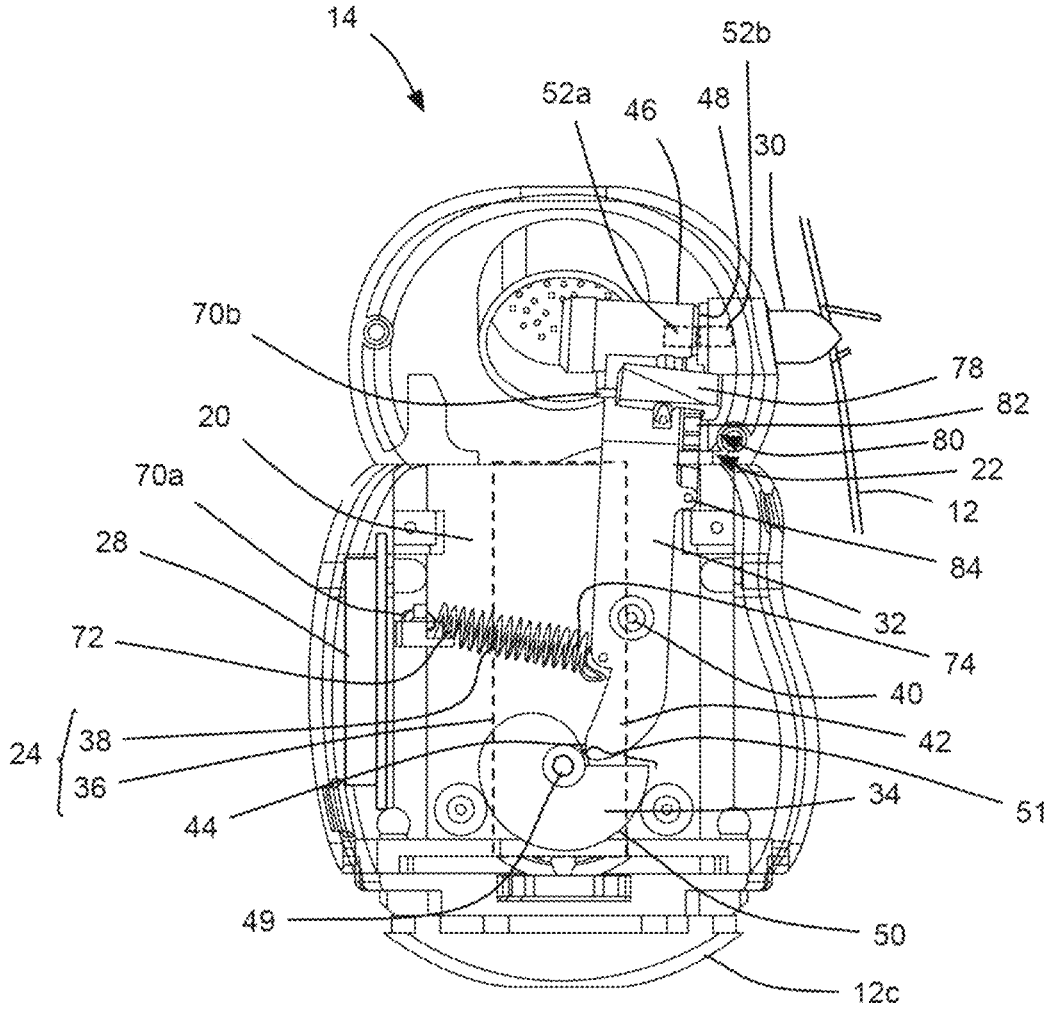
FIG. 5 is a sectional side view of the toy character shown in FIG. 2, in a pre-breakout position, after engagement of a hammer that is part of a breakout mechanism.

The toy character 14 is shown mounted only on the housing member 12*c* in FIG. 3. Referring to FIGS. 4 and 5, the toy character 14 includes a toy character frame 20, a breakout mechanism 22, a breakout mechanism power source 24 and a controller 28. The breakout mechanism 22 is operable to break the housing 12 (e.g., to fracture the housing 12 along at least one of the fracture paths 16) to expose the toy character 14. The breakout mechanism 22 includes a hammer 30, an actuation lever 32 and a breakout mechanism cam 34. The hammer 30 is movable between a retracted position (FIG. 4) in which the hammer 30 is spaced from the housing 12 and an advanced position (Figure in which the hammer 30 is positioned to break the housing 12.

The actuation lever 32 is pivotably mounted via a pin joint 40 to the toy character frame 20 and is movable between a hammer retraction position (FIG. 4) in which the actuation lever 32 is positioned to permit the hammer 30 to move to the retracted position, and a hammer driving position (FIG. 5) in which the actuation lever 32 drives the hammer 30. The actuation lever 32 is biased towards the hammer driving position by an actuation lever biasing member 38. In other words, the actuation lever 32 is biased by the biasing member 38 towards driving the hammer 30 to the extended position. The actuation lever 32 has a first end 42 with a cam engagement surface 44 thereon, and a second end 46 with a hammer engagement surface 48 thereon, which will be described further below.

The breakout mechanism cam 34 may sit directly on an output shaft (shown at 49) of a motor 36 and is thus rotatable by the motor 36. The breakout mechanism cam 34 has a cam surface 50 that is engaged with the cam engagement surface 44 on the first end 42 of the actuation lever 32. When the breakout mechanism cam 34 is rotated by the motor 36 (in the clockwise direction in the views shown in FIGS. 4 and 5), from the position shown in FIG. 4 to the position shown in FIG. 5) a stepped region shown at 51 on the cam surface 50 causes the cam surface 50 to drop away from the actuation lever 32 abruptly, permitting the biasing member 38 to accelerate the actuation lever 32 to impact at relatively high speed with the hammer 30, thereby driving the hammer 30 forward (outward) from the frame 20 at relatively high speed, which provides a high impact energy when the hammer 30 hits the housing 12, so as to facilitate breaking of the housing 12. In some embodiments, this will present the appearance of a bird pecking its way out of an egg.

As the breakout mechanism cam 34 continues to rotate, the cam surface 50 draws the actuation lever 32 back to the retracted position that is shown in FIG. 4. The hammer engagement surface 48 of the actuation lever 32 may have a first magnet 52*a* there in that is attracted to a second magnet 52*b* in the hammer 30. As a result, during the drawing back of the actuation lever 32, the actuation lever 32 pulls the hammer 30 back to a retracted position shown in FIG. 4.

The breakout mechanism cam 34 is rotatable by the motor 36 to cyclically cause retraction of the actuation lever 32 from the hammer 30 and then release of the actuation lever 32 to be driven into the hammer 30 by the actuation lever biasing member 38. Thus, the motor 36 and the actuation lever biasing member 38 may together make up the breakout mechanism power source 24.

The breakout mechanism biasing member 38 may be a helical coil tension spring as shown in the figures, or alternatively it may be any other suitable type of biasing member.

Figure 6:
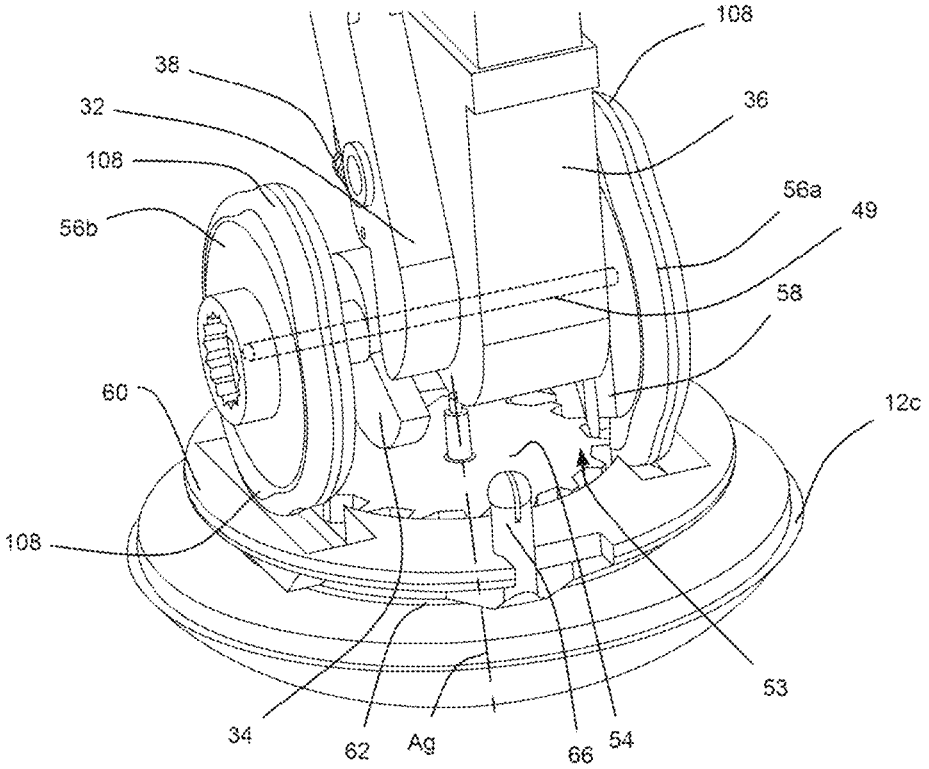
FIG. 6 is a perspective view of a portion of the toy character that causes rotation of the toy character inside the housing.

Additionally, the toy character 14 includes a rotation mechanism shown at 53 in FIG. 6. The rotation mechanism 53 is configured to rotate the toy character 14 in the housing 12. The controller 28 is configured to operate the rotation mechanism 53 when operating the breakout mechanism in order to break the housing 12 in a plurality of places.

Figure 6A:
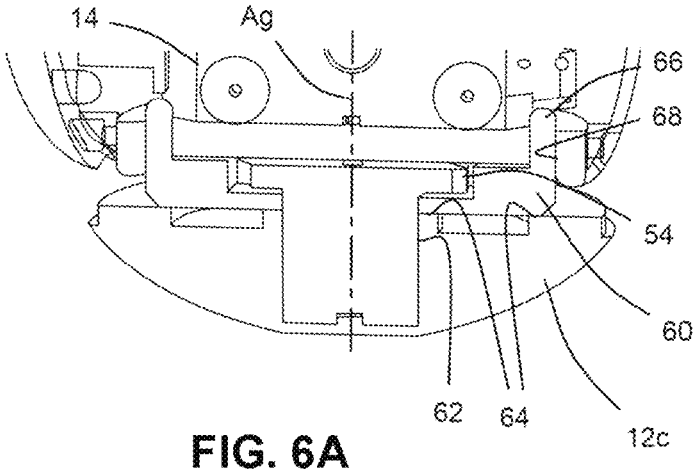
FIG. 6A is a sectional side view of the portion of the toy character shown in FIG. 6.

The rotation mechanism 53 may be any suitable rotation mechanism. In the embodiment shown in FIG. 6, the rotation mechanism 53 includes a gear 54 that is fixedly mounted to the bottom housing member 12*c*. The output shaft 49 of the motor 36 is a dual output shaft that extends from both sides of the motor 36 and drives first and second wheels 56*a* and 56*b*. On one of the wheels, (in the example shown, on the first wheel 56*a*) is a drive tooth 58. When the motor 36 turns the output shaft 49, the drive tooth 58 on the first wheel 56*a* engages the gear 54 once per revolution of the output shaft 49 and drives the toy character 14 to rotate relative to the housing 12. A bushing supports the toy character 14 for rotation about the axis (shown at Ag) of the gear 54. In the example shown, the bushing 60 is slidably, rotatably engaged with a shaft 62 of the gear 54, and is axially supported on support surface 64 of the bottom housing member 12*c*, as shown in FIG. 6A. The toy character 14 may be releasably held to the bushing via projections 66 on the bushing 60 that engage apertures 68 on the toy character frame 20. When the toy character 14 is desired to be removed from the bushing 60, a user may pull the toy character 14 off of the projections 66. The bushing 60 also supports the wheels 56*a* and 56*b* off of the housing 12. As a result, while the toy character 14 is in the housing 12, rotational indexing of the toy character 14 takes place by sliding of the bushing 60 on the bottom housing member 12*c* and without engagement of the wheels 56*a* and 56*b* on the housing member 12*c*.

As can be seen from the description above, once per revolution of the output shaft 49, the rotation mechanism 53 rotates the toy character 14 by a selected angular amount (i.e., the rotation mechanism 53 rotationally indexes the toy character 14), and the actuation lever 32 is drawn back to a retracted position and then released to drive the hammer 30 forward to engage and break the housing 12. Thus, continued rotation of the motor 36 causes the toy character 14 to eventually break through the entire perimeter of the housing 12.

Figure 7:
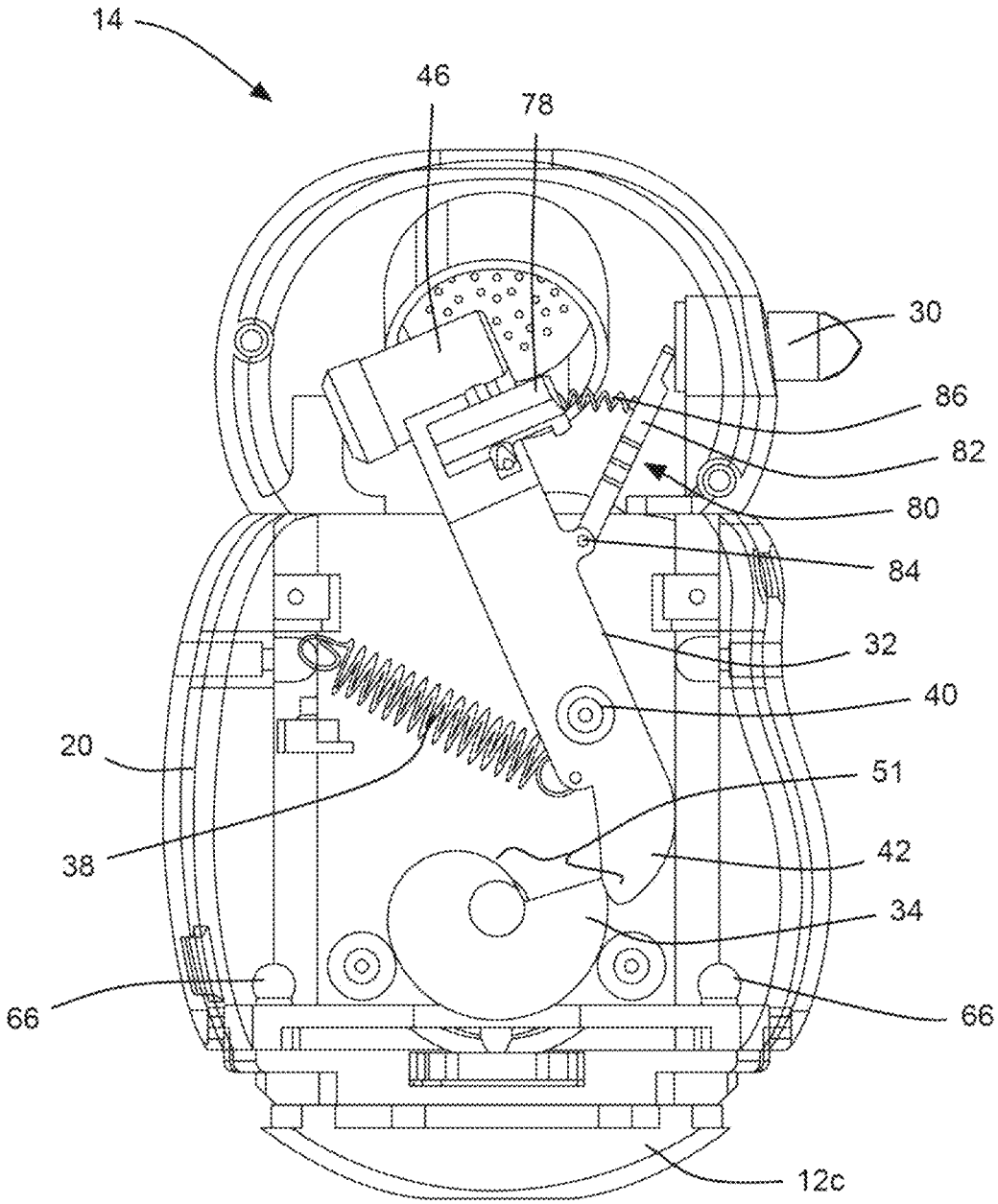
FIG. 7 is a sectional side view of the toy character shown in FIG. 2, in a post-breakout position, showing the hammer extended.

Once the toy character 14 has broken through the housing 12, a user can help to free the toy character 14 from the housing 12. It will be noted that the housing member 12*c* may be left to serve as a base for the toy character 14 if desired in some embodiments. Once the toy character 14 is freed from the housing 12 and the hammer is no longer needed to break through the housing 12, the user may move at least one release member from a pre-breakout position to a post-breakout position. In the example shown in FIG. 5, there are two release members, namely a first release member 70*a*, and a second release member 70*b*. Prior to breaking of the housing 12 to expose the toy character 14, the release members 70*a* and 70*b* are in the pre-breakout position. When in the pre-breakout position, the first release member 70*a* connects the first end (shown at 72) of the actuation lever biasing member 38 to the toy character frame 20. The second end (shown at 74) of the biasing member 38 is connected to the actuation lever 32, and therefore, the biasing member 38 is connected to drive the hammer 30 forward (via actuation of the actuation lever 32) to break the housing 12. Movement of the release member 70*a* to the post-breakout position in the example shown, entails removal of the release member 70*a* such that the biasing member 38 is disabled from driving the actuation lever 32 and therefore the hammer 30, as shown in FIG. 7. As a result, when the motor 36 rotates, which causes rotation of the breakout mechanism cam 34, the passing of the stepped region 51 of the cam surface 50 does not cause the actuation lever 32 to be driven into the hammer 30.

Figure 8:
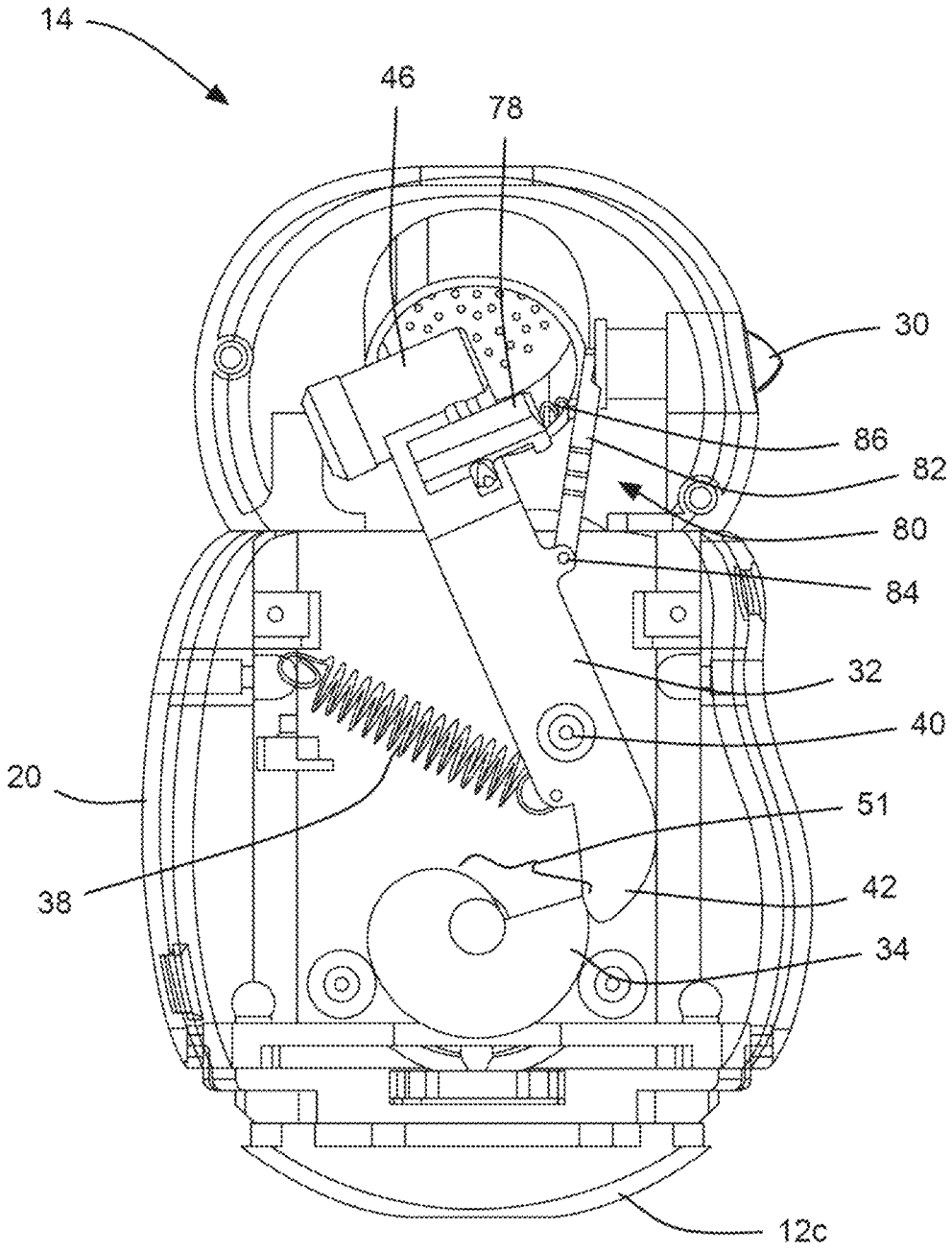
FIG. 8 is a sectional side view of the toy character shown in FIG. 2, in a post-breakout position, showing the hammer retracted.

With reference to FIG. 4, the second release member 70*b*, when in the pre-breakout position, holds a locking lever 78 in a locking position so as to hold a hammer biasing structure 80 in a non-use position. In the non-use position the hammer biasing structure 80 is fixedly held to the actuation lever 32 and acts as one with the actuation lever 32. With reference to FIGS. 7 and 8, when the second release member 70*b* is moved from the pre-breakout position to the post-breakout position, the locking lever 78 releases the hammer biasing structure 80. The hammer biasing structure 80 includes a pivot arm 82 that is pivotally connected to the actuation lever 32 (e.g., via a pin joint 84), and a pivot arm biasing member 86 that may be a compression spring or any other suitable type of spring that acts between the actuation lever 32 and the pivot arm 82 so as to urge the pivot arm 82 into the hammer 30 to urge the hammer 30 towards the extended position shown in FIG. 7. As a result, the hammer 30 can integrate into the toy character's appearance. In the embodiment shown, wherein the toy character 14 is in the form of a bird, the hammer 30 is the beak of the bird. Because the hammer 30 is urged outwards by the biasing member 86 and is not locked in the extended position, it may be pushed in against the biasing force of the biasing member 86 by an external force (e.g., by the user), as shown in FIG. 8, which can reduce the risk of a poking injury to a child playing with the toy character 14.

Figure 9:
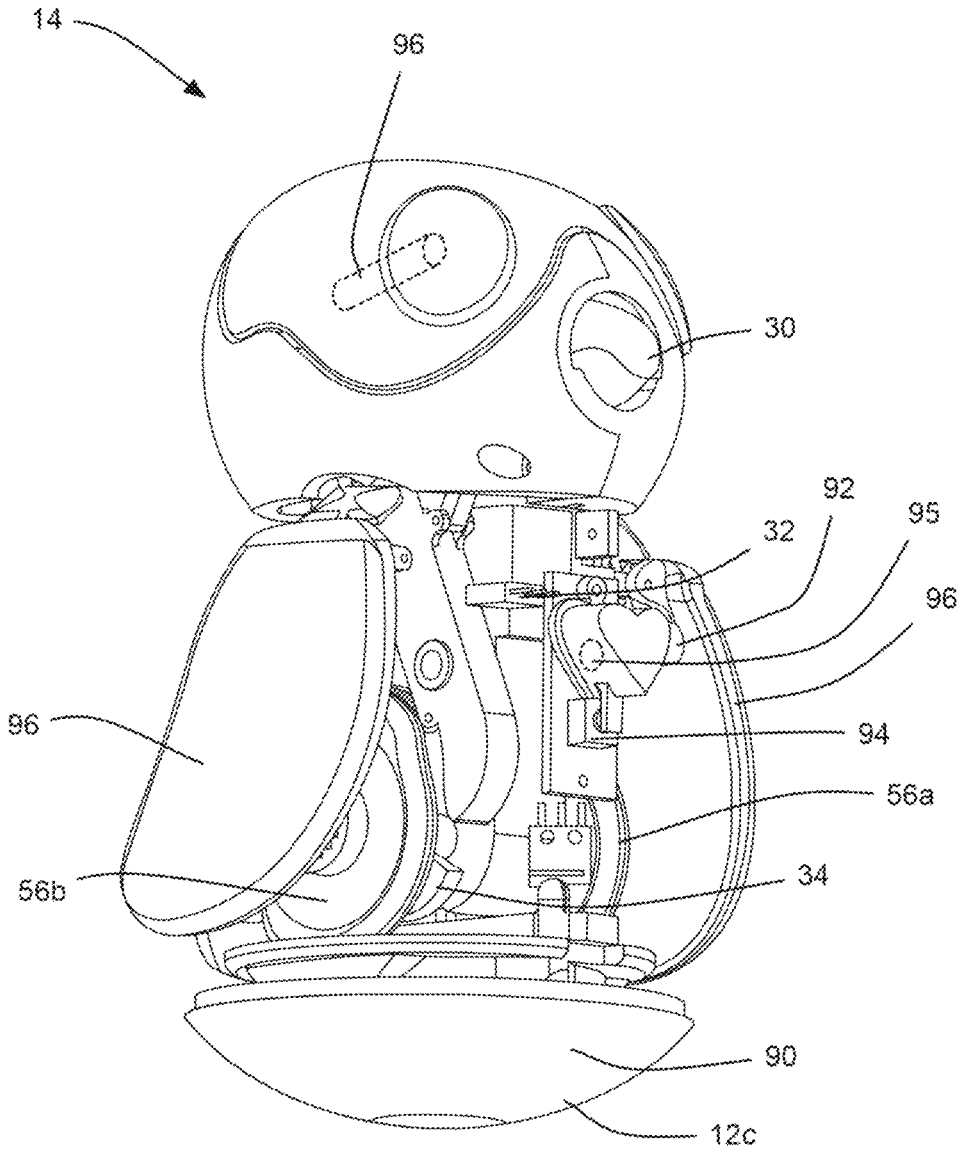
FIG. 9 is a perspective view of a portion of the toy assembly shown in FIGS. 1A and 1B, showing sensors that are part of the toy assembly.

Any suitable scheme may be used to initiate breaking out of the housing 12 by the toy character 14. For example, as shown in FIG. 9, at least one sensor may be provided in the toy assembly 10 which detects interaction with a user while the toy character 14 is in the housing 12. For example, a capacitive sensor 90 may be provided on the bottom of the housing member 12*c* so as to detect holding by a user. A microphone 92 may be provided on the toy character frame 20 to detect audio input by a user. A pushbutton 94 may be provided on the front of the toy character 14. A tilt sensor 96 may be provided on the toy character 14 to detect tilting of the toy character 14 by the user. The controller 28 may count the number of interactions that a user has had with the toy assembly 10 and operate the breakout mechanism 22 so as to break the housing 12 and expose the toy character 14 if a selected condition is met. For example, the condition may be a selected number of interactions with a user, such as 120 interactions. Interaction with the toy character 14 using the microphone 92 could entail the user saying a command that is recognized by the controller 28, or alternatively it could entail the user making any kind of noise such as a clap or a tap, which would be received by the microphone 92. An interaction could entail the user holding or touching the housing 12 in places where the capacitive sensor will receive it. In another example, an interaction could entail the user pushing the pushbutton 94 of the toy character 14 by pressing on the correct spot on the housing 12, which may be sufficiently flexible and resilient to transmit the force of the press through to the pushbutton 94. The pushbutton 94 may control operation of an LED that is inside the toy character 14 and is sufficiently bright to view through the housing 12. The LED 95 may illuminate in different colours (controlled by the controller 28) to indicate to the user the 'mood' of the toy character 14, which may depend on factors including the interactions that have occurred between the toy character 14 and the user.

Figure 10A:
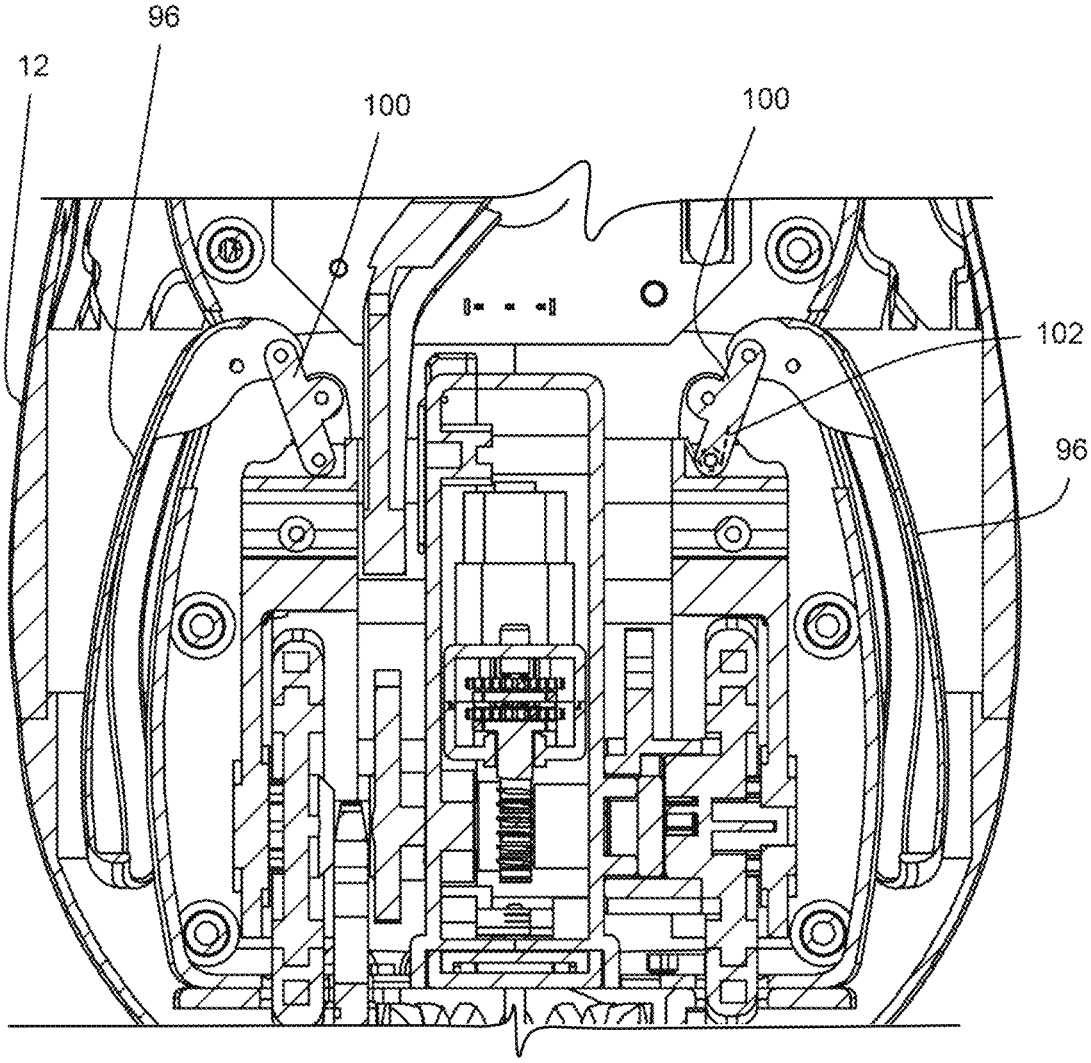
FIG. 10A is a front elevation view of a portion of the toy assembly, illustrating a limb of the toy character in a non-functional, pre-breakout position as it is positioned when inside the housing.
Figure 10B:
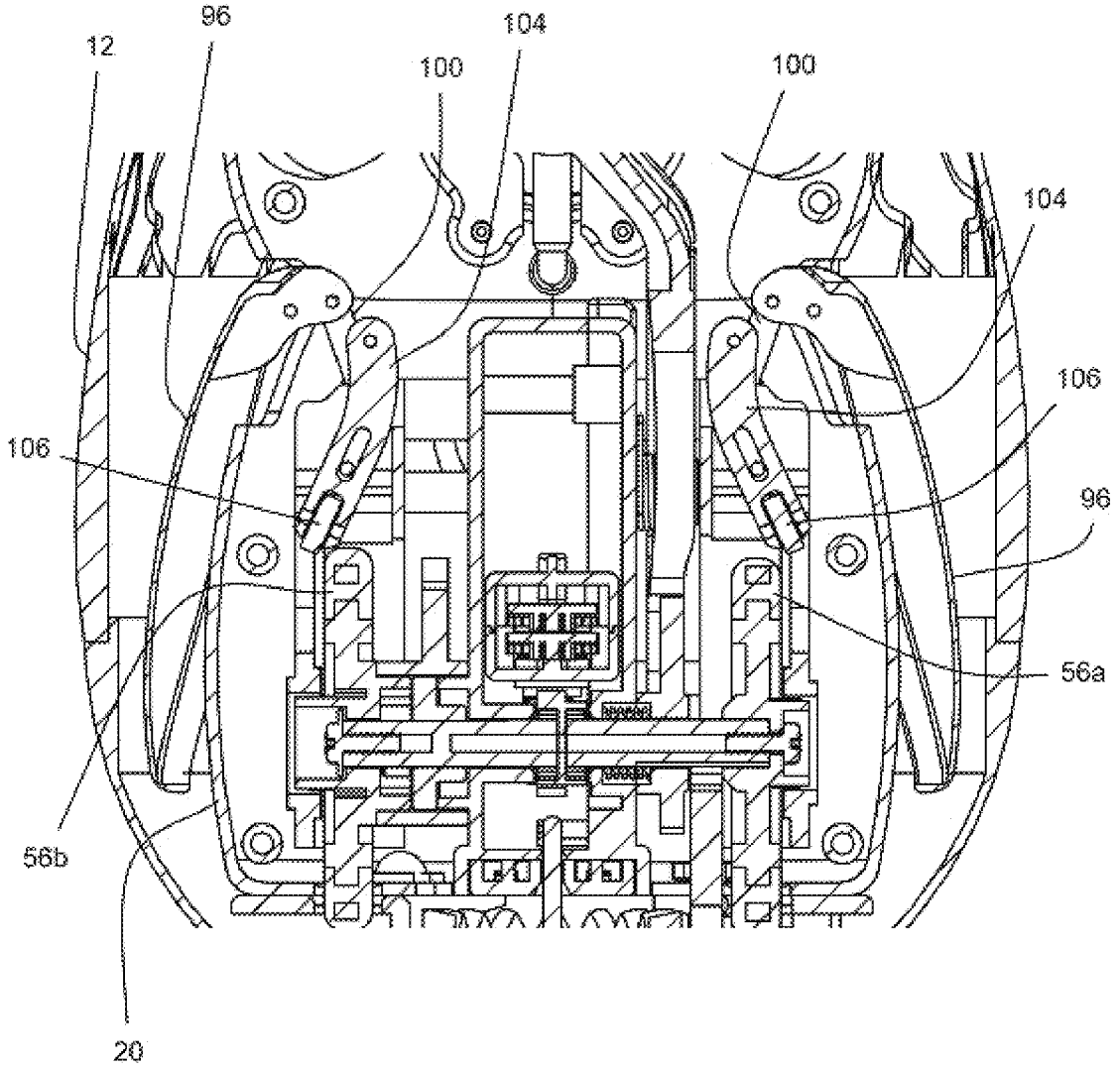
FIG. 10B is a rear perspective view of the portion of the toy assembly, further illustrating the limb of the toy character in the non-functional, pre-breakout position as it is positioned when inside the housing.
Figure 10C:
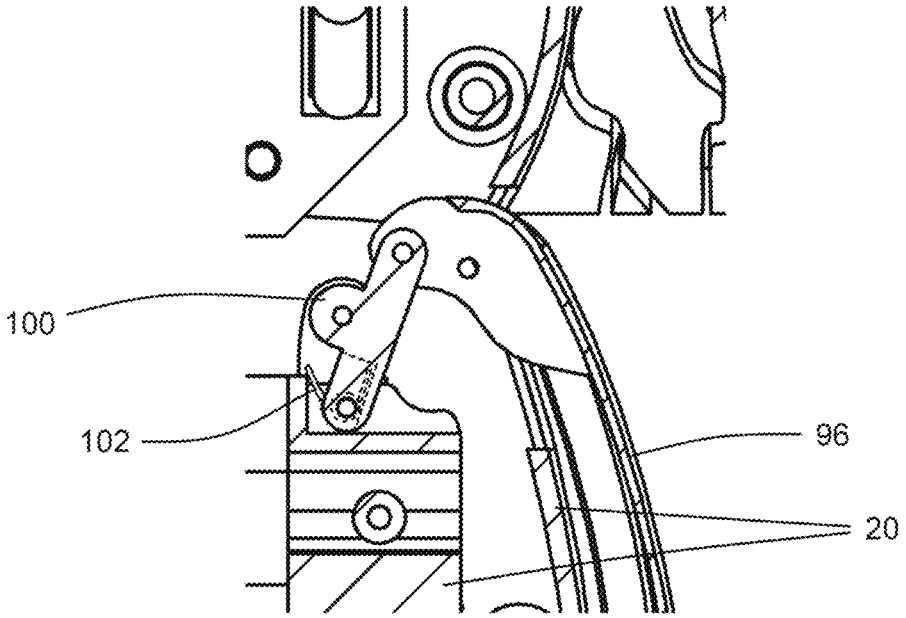
FIG. 10C is a magnified front elevation view of a joint between a limb and a character frame of the toy character.
Figure 10D:
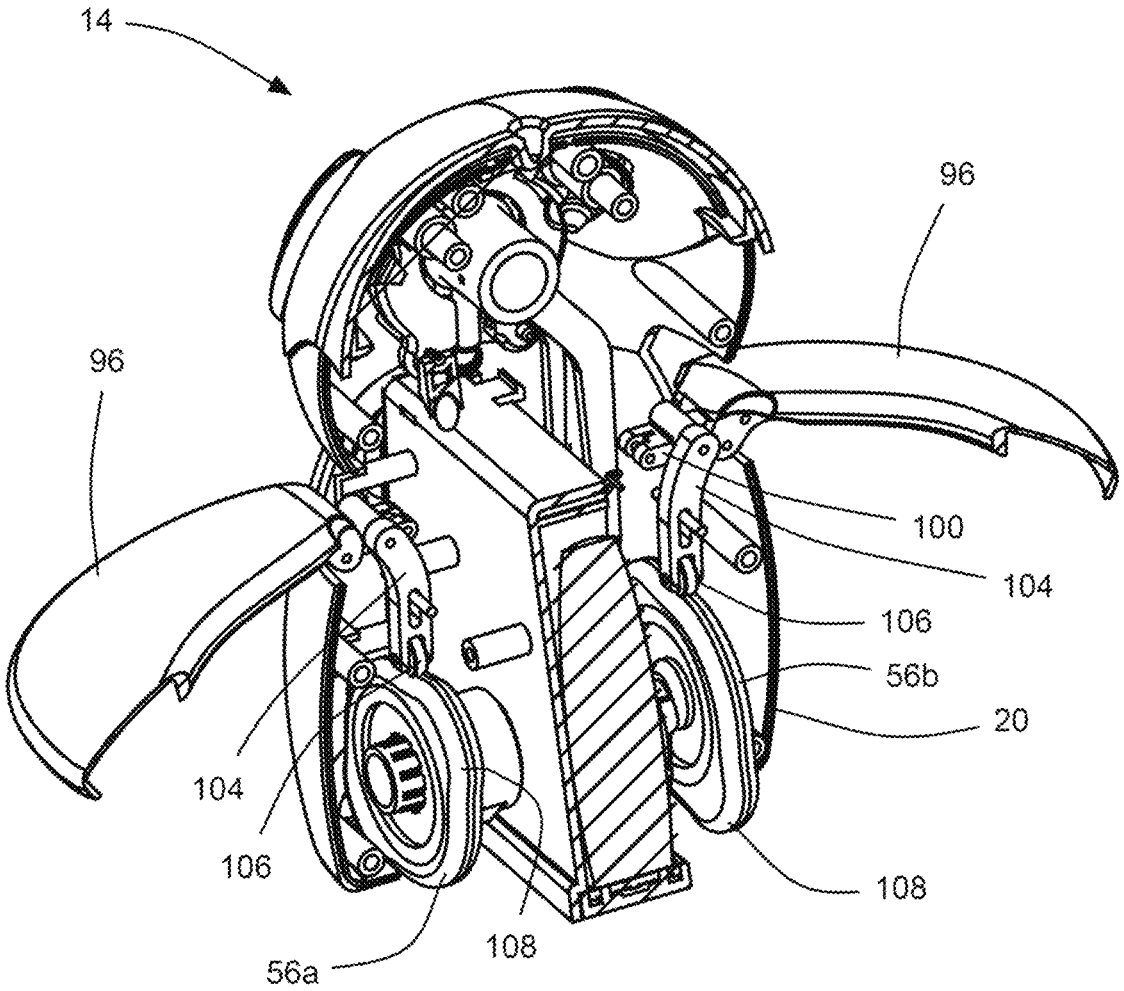
FIG. 10D is a perspective view of the portion of the toy assembly illustrating the limb of the toy character in the functional, post-breakout position as it is position when outside the housing.

When the toy character 14 is outside of the housing 12, the toy character 14 may carry out movements that are different than those carried out inside the housing 12. For example, the toy character 14 may have at least one limb 96. In the example shown, there are provided two limbs 96 which are shown as wings but which may be any suitable type of limb. When inside the housing, the wings 96 are positioned in a pre-breakout position in which they are non-functional, as shown in FIGS. 10A, 10B and 10C, and, when outside the housing, are positioned in a post-breakout position in which they are functional, as shown in FIG. 10D. As shown in FIG. 10D, the wings 96 are connected to the character frame 20 via a wing connector link 100 that is pivotally mounted at one end to the associated wing 96 and at another end to the character frame 20. For each wing 96, a wing driver arm 104 is pivotally connected at one end to the associated wing 96 and has a wing driver arm wheel 106 at the other end. The wing driver arm wheels 106 rest on the toy character's main wheels 56*a* and 56*b* when the toy character 14 is in the post-breakout position. The toy character's main wheels 56*a* and 56*b* have a cam profile on them with at least one lobe 108 on each wheel (shown in FIG. 6, in which two lobes 108 are provided on each wheel). The lobes 108 serve two purposes. Firstly, as the motor 36 turns, the wheels 56*a* and 56*b* drive the toy character 14 along the ground, and the lobes 108 lend a wobble to the toy character 14 to give it a more lifelike appearance when it rolls along the ground. Secondly, as the wheels 56*a* and 56*b* turn, the presence of the lobes 108 cause the wheels 56*a* and 56*b* to act as wing driver cams, which drive the wing driver arms 104 up and down as the wing driver arm wheels 106 follow the cam profiles of the main wheels 56*a* and 56*b*. The up and down movement of the wing driver arms 104 in turn, drives the wings 96 to pivot up and down, giving the toy character 14 the appearance of flapping its wings as it travels along the ground. Preferably, the lobes 108 on the first wheel 56*a* are offset rotationally relative to the lobes 108 on the second wheel 56*b* so that the toy character 14 has a side-to-side wobble as the toy character rolls to enhance the lifelike appearance of its motion.

For each wing connector link 100, a wing connector link biasing member 102 (FIG. 10C) biases the associated wing connector link 100 to urge the associated wing 96 downward to maintain contact between the driver arm wheels 106 and the main wheels 56*a* and 56*b* when the character is in the post-breakout position shown in FIG. 10D.

In the example shown, where the limbs 96 are wings, the driver arms 104 are referred to as wing driver arms, the driver arm wheels 106 are referred to as wing driver arm wheels 106 and the wheels 56*a* and 56*b* are referred to as wing driver cams. However, it will be understood that if the wings 96 were any other suitable type of limbs, the driver arms 104 and the driver arm wheels 106 may more broadly be referred to as limb driver arms 104 and limb driver arm wheels 106 respectively, and the wheels 56*a* and 56*b* may be referred to as limb driver cams.

The motor 36 drives the limbs 96 in the example shown, by driving the wheels 56*a* and 56*b*. Thus, when the limbs 96 are in the post-breakout position, the motor 36 is operatively connected to the limbs 96.

The motor 36 is thus the limb power source. However, the motor 36 is just an example of a suitable limb power source, and alternatively any other suitable type of limb power source could be used to drive the limbs 96.

When the wings 96 are in the pre-breakout position (FIGS. 10A-10C), the links 100 may hinge relative to the character frame 20 as needed so that the wings fit within the confines of the housing 12. In the example shown the wing connector links 100 hinge upwardly against the biasing force of the biasing members 102. While in the housing 12, the wings 96 thus remain in their non-functional position wherein the wing driver arms 104 are held such that the wing driver arm wheels 106 are disengaged from the toy character's main wheels 56*a* and 56*b*. Thus, the motor 36 (i.e., the limb power source) is operatively disconnected from the limbs 96 when the limbs 96 are in the pre-breakout position. As a result, when the toy character 14 is in the housing 12 and the motor 36 rotates (e.g., to cause movement of the breakout mechanism 22), the rotation of the main wheels 56*a* and 56*b* does not cause movement of the wings 96. As a result, the wings 96 do not cause damage to the housing 12 during operation of the motor 36 while the character 14 is in the housing 12.

The motor 36 depicted in the figures includes an energy source, which may be one or more batteries.

Figure 11:
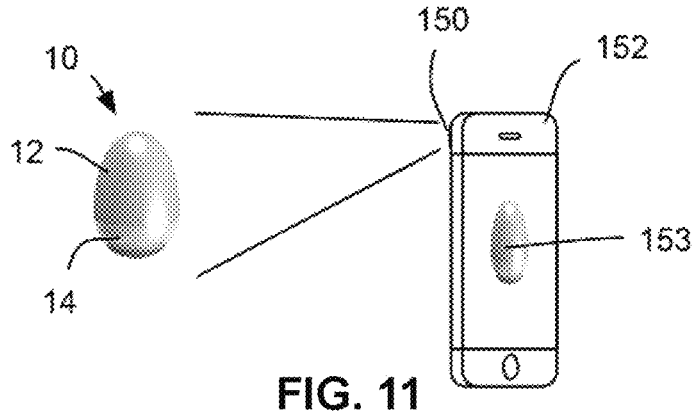
FIG. 11 is a perspective view of the toy assembly and an electronic device used to scan the toy assembly.

Reference is made to FIG. 11, which illustrates a way that a user can play with the toy assembly 10 prior to breakout of the toy character 14 from the housing 12. The lower housing member 12*b* is shown as transparent in FIG. 11 to show the toy character 14 inside. At a first point in time, the user may scan the toy assembly by any suitable means, such as by a camera 150 on a smartphone 152 to produce a first progress scan 153 of the toy assembly 10 (i.e., which may be an image of the toy assembly 10 taken from the smartphone camera 150). The user may then upload the scan 153 to a server 154 as part of, or after, registering the toy assembly 10 via a network such as the internet, shown at 156. The server 156 may, in response to the uploaded scan, generate an output image 158*a* representing a first virtual stage of development of the toy character 14 in the housing 12, so as to convey the impression to the user that the toy character 14 is a living entity growing inside the housing 12. The output image 158*a* may be displayed electronically (e.g., on the smartphone 152). The user may at a second, later point in time take a second progress scan 153 of the toy assembly 10 and may upload it to the server 154, whereupon the server 154 will generate a second output image 158*b* (shown in FIG. 13B) that represents a second virtual stage of development of the toy character 14 inside the housing 12. In the second virtual stage of development the toy character 14 may appear to be further developed than in the first virtual stage of development.

Figure 12:
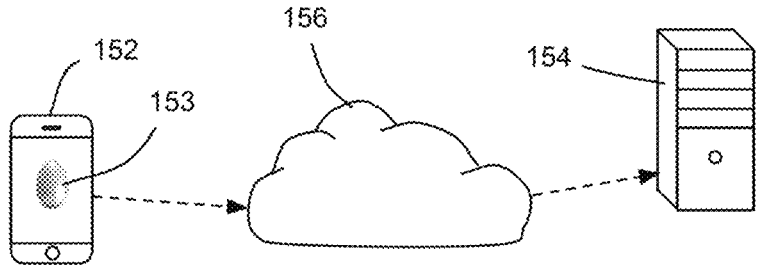
FIG. 12 is a schematic view illustrating the uploading the scan of the toy assembly to a server.
Figure 13A:
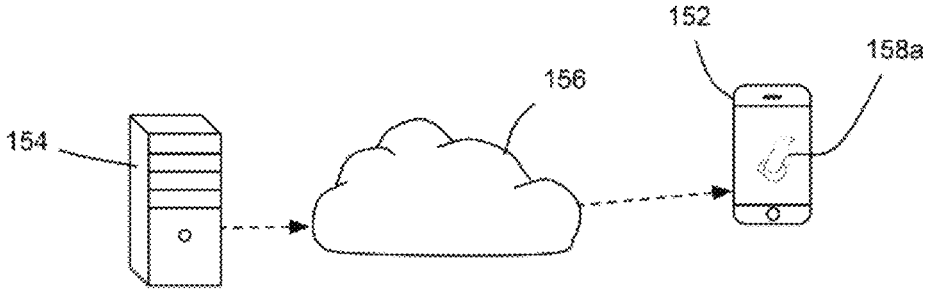
FIG. 13A is a schematic view illustrating transmitting an output image from the server to be displayed electronically showing a first virtual stage of development for the toy character.
Figure 13B:
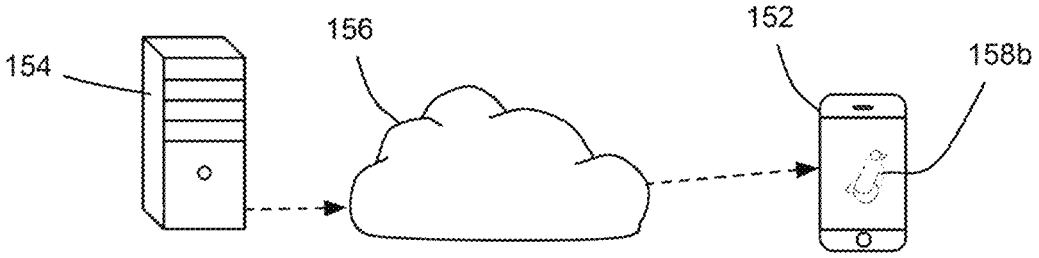
FIG. 13B is a schematic view illustrating transmitting an output image from the server to be displayed electronically showing a second virtual stage of development for the toy character.
Figure 14:
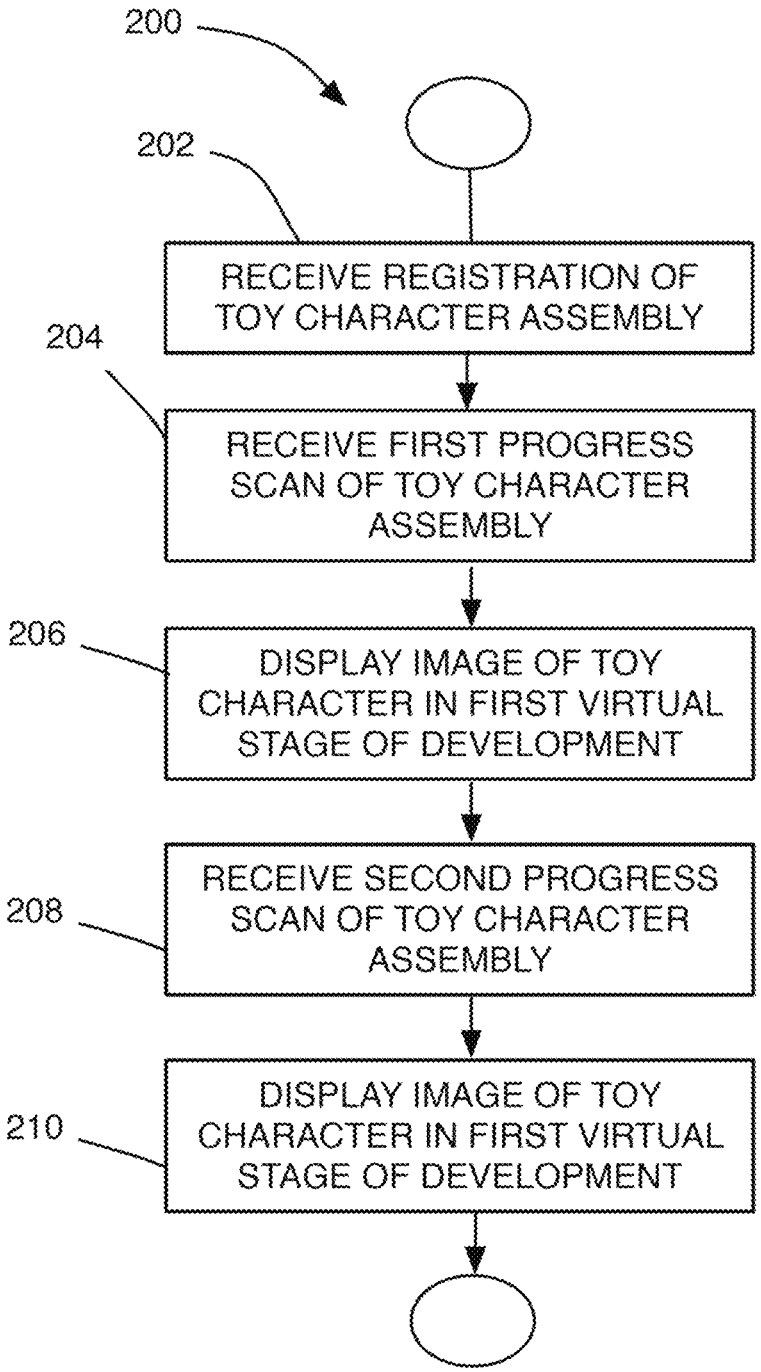
FIG. 14 is a flow diagram of a method of receiving the scan from the electronic device and depicting the toy character based on steps illustrated in FIGS. 11 and 13.

FIG. 14 is a flow diagram of a method 200 of managing an interaction between a user and the toy assembly 10 in accordance with the actions depicted in FIGS. 11-13. The method 200 begins at 201, and includes a step 202 which is receiving from the user a registration of the toy assembly 14. This may take place by receiving from a user, information regarding the model number or serial number of the toy assembly 14. Step 204 includes receiving from the user after step 202, a first progress scan of the toy assembly, as depicted in FIG. 12. Step 206 includes displaying an image of the toy character 14 in a first stage of virtual development, as depicted in FIG. 13A. Step 208 includes receiving from the user after step 206, a second progress scan of the toy assembly 10, as depicted in FIG. 12 again. Step 210 includes displaying a second output image 158*b* of the toy character 14 in a second stage of virtual development that is different than the first output image 158*a* depicting the first stage of development, as shown in FIG. 13B.

While it has been described for the toy assembly 10 to include a controller and sensors, and to include the breakout mechanism inside the toy character 14, many other configurations are possible. For example, the toy assembly 10 could be provided without a controller or any sensors. Instead the toy character 14 could be powered by an electric motor that is controlled via a power switch that is actuatable from outside the housing 12 (e.g., the switch may be operated by a lever that extends through the housing 12 to the exterior of the housing 12).

The breakout mechanism 22 has been shown to be provided inside the toy character 14. It will be understood that this location is just an example of a location in association with the housing 12 in which the breakout mechanism 22 can be positioned. In other embodiments, the breakout mechanism can be positioned outside the housing 12, while remaining in association with the housing 12. For example, in embodiments in which the housing 12 is shaped like an egg (as is the case in the example shown in the figures), a 'nest' can be provided, which can hold the egg. The nest may have a breakout mechanism built into it that is actuatable to break the egg to reveal the toy character 14 within. Thus, in an aspect, a toy assembly may be provided, that includes a housing, such as the housing 12, a toy character inside the housing, that is similar to the toy character 14 but wherein a breakout mechanism is provided that is associated with the housing, whether the breakout mechanism is within the housing or outside of the housing, or partially within and partially outside of the housing, and that is operable to break the housing 12 to expose the toy character 14. The breakout mechanism is powered by a breakout mechanism power source (e.g., a spring, or a motor) that is associated with the housing 12. In some embodiments (e.g., as shown in FIG. 3), the breakout mechanism includes a hammer (such as the hammer 30), which the breakout mechanism power source is operatively connected to, so as to drive the hammer to break the housing 12. In some embodiments (e.g., as shown in FIG. 4), the breakout mechanism power source is operatively connected to the hammer to reciprocate the hammer to break the housing 12.

Another aspect of the invention relates to the movement of the toy character 14 when in the pre-breakout position and when in the post-breakout position. More specifically, the toy character 14 may be said to include a functional mechanism set that includes all of the movement elements of the toy character 14, including, for example, the limbs 96, the main wheels 56, the limb connector links 100 and associated biasing members 102, the limb driver arms 104, the driver arm wheels 106, the hammer 30, the actuation lever 32, the breakout mechanism cam 34, the motor 36 and the actuation lever biasing member 38. The toy character 14 is removable from the housing 12 and is positionable in a post-breakout position. When the toy character 14 is in the pre-breakout position, the functional mechanism set is operable to perform a first set of movements. In the example shown, the limb power source (i.e., the motor 36) is operatively disconnected from the limbs 96, and so movement of the limb power source 36 does not drive movement of the limbs 96. However, in the pre-breakout position, the breakout mechanism power source drives movement of the breakout mechanism 22 (by reciprocating the hammer 30 and indexing the toy character 14 around in the housing 12) so as to break the housing 12 and expose the toy character 14. When the toy character 14 is in the post-breakout position, the functional mechanism set that is operable to perform a second set of movements that is different than the first set of movements. For example, when the toy character 14 is in the post-breakout position the limb power source 36 is operatively connected to the limbs 96 and can drive movement of the limbs 96, but the breakout mechanism 22 is not driven by the breakout mechanism power source.

Some optional aspects of the play pattern for the toy assembly are described below. While the toy character 14 is in the housing 12 (when the toy character 14 is still in the pre-break out stage of development), the user can interact with the toy character in several ways. For example, the user can tap on the housing 12. The tapping can be picked up by the microphone on the toy character 14. The controller 28 can interpret the input to the microphone, and, upon determining that the input was from a tap, the controller 28 can output a sound from the speaker that is a tap sound, so as to appear as if the toy character 14 is tapping back to the user. Alternatively, or additionally, the controller 28 may initiate movement of the hammer 30 as described above, depending on whether the controller 28 can control the speed of the hammer 30, so as to knock the hammer 30 against the interior wall of the housing 12, lightly enough that it can be sensed by the user, but not so hard that it risks breaking the housing 12. The controller 28 may be programmed (or otherwise configured) to emit sounds indicating annoyedness in the event that the user taps too many times within a certain amount of time or according to some other criteria. Optionally, if the user turns the toy assembly 10 upside down a first time, the controller 28 may be programmed to emit a 'Weee!' sound from the speaker of the toy character 14. If the user turns the toy assembly 10 upside down more than a selected number of times within a certain period of time, then the controller 28 may be programmed to emit a sound (or some other output) that indicates that the toy character 14 is queasy. Optionally, when the controller 28 detects, via the capacitive sensors, that the user is holding the housing 12, the controller 28 may be programmed to emit a heartbeat sound from the toy character 14. Optionally, the controller 28 may be configured to indicate that it is cold using any suitable criteria and may be programmed to stop indicating that it is cold when the controller 28 detects that the user is holding or rubbing the housing 12. Optionally, the controller 28 is programmed to emit sounds indicating that the toy character 14 has the hiccups and to stop indicating this upon receiving a sufficient number of taps from the user. The controller 28 may be programmed to indicate to the user that the toy character 14 is bored and would like to play and may be programmed to stop such indication when the user interacts with the toy assembly 10.

Optionally, when the controller 28 has determined that the criteria have been met for it to leave the pre-break out stage of development and break out of the housing 12, the controller 28 may cause the LED to flash a selected sequence. For example, the LED may be caused to flash a rainbow sequence (red, then orange, then yellow, then green, then blue, then violet). After this, the toy character 14 may begin hitting the housing 12 a selected number of times, after which it may stop and wait for the user to interact further with it before beginning to hit the housing 12 again by a selected number of times.

Optionally, after the toy character 14 has initially broken out of the housing 12, the controller 28 may be programmed to act in a first stage of development after 'hatching' (i.e., after the toy character 14 is released from the housing 12) to emit sounds that are baby-like and to move in a baby-like manner, such as for example only being able to spin in a circle. During this first stage, the controller 28 may be programmed to require the user to interact with the toy character 14 in selected ways that symbolize petting of the toy character 14, feeding the toy character 14, burping the toy character 14, comforting the toy character 14, caring for the toy character 14 when the toy character 14 emits output that is indicative of being sick, putting the toy character 14 down for a nap, and playing with the toy character 14 when the toy character 14 emits output that is indicative of being bored. In this first stage, the toy character 14 may emit output that indicates fear from sounds beyond a selected loudness. In this stage, the toy character may generally emit baby-like sounds, such as gurgling sounds when the user attempts to communicate with it verbally.

Optionally, after some criteria are met during the first stage (e.g., a sufficient amount of time has passed, or a sufficient number of interactions (e.g., 120 interactions) have passed between the user and the toy character 14) the controller 28 may be programmed to change its mode of operation to a second stage after 'hatching' (i.e., after the toy character 14 is released from the housing 12). Optionally, the LED will emit the rainbow sequence again to indicate that the criteria have been met and that the toy character is changing its stage of development.

In the second stage of development, the toy character 14 can move linearly as well as moving in a circle. Additionally, the sounds emitted from the toy character 14 may sound more mature. Initially in the second stage of development after hatching, the controller 28 may be programmed to drive the toy character 14 to move linearly, but not smoothly—the motor 38 may be driven and stopped in a random manner to give the appearance of a toddler learning to walk. Over time the motor 38 is driven with less stopping giving the toy character 14 the appearance of a more mature capability to 'walk'. In this second stage of development, the toy character 14 may be capable of emitting sounds at the cadence that the user used when speaking to the toy character 14. Also in this second stage of development, games involving interaction with the toy character 14 may be unlocked and played by the user.

Figure 20:
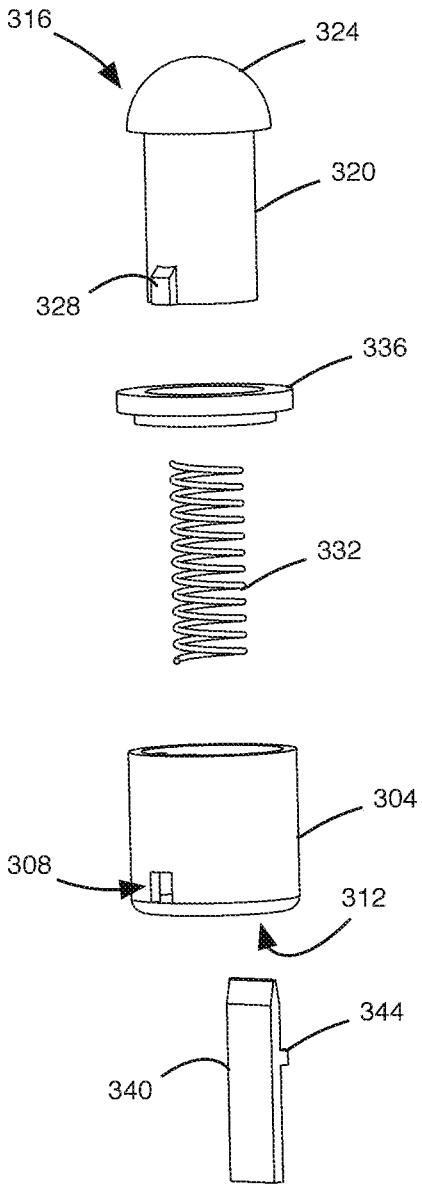
FIG. 20 is a sectional side view of a breakout mechanism forming part of a toy assembly according to another non-limiting embodiment prior to activation via release of a tab.

FIG. 20 illustrates a breakout mechanism 300 in accordance with another embodiment of the present disclosure. The breakout mechanism 300 includes a base member 304 that is generally cup-shaped, having a feature, a plunger locking recess 308, in its side wall and a slot 312 in its base wall. A plunger member 316 has a tubular body 320 and a rounded cap 324. The outer circumference of the tubular body 320 of the plunger member 316 is dimensioned to be smaller than the internal circumference of the side wall of the base member 304, enabling the tubular body 320 to shift laterally as needed within the base member 316. A feature along the outer surface of the tubular body 320, a protrusion 328, at a proximal end of the body 320 (i.e. the opposite end from the rounded cap 324) is sized to fit within the plunger locking recess 308 of the base member 304.

Figure 25:
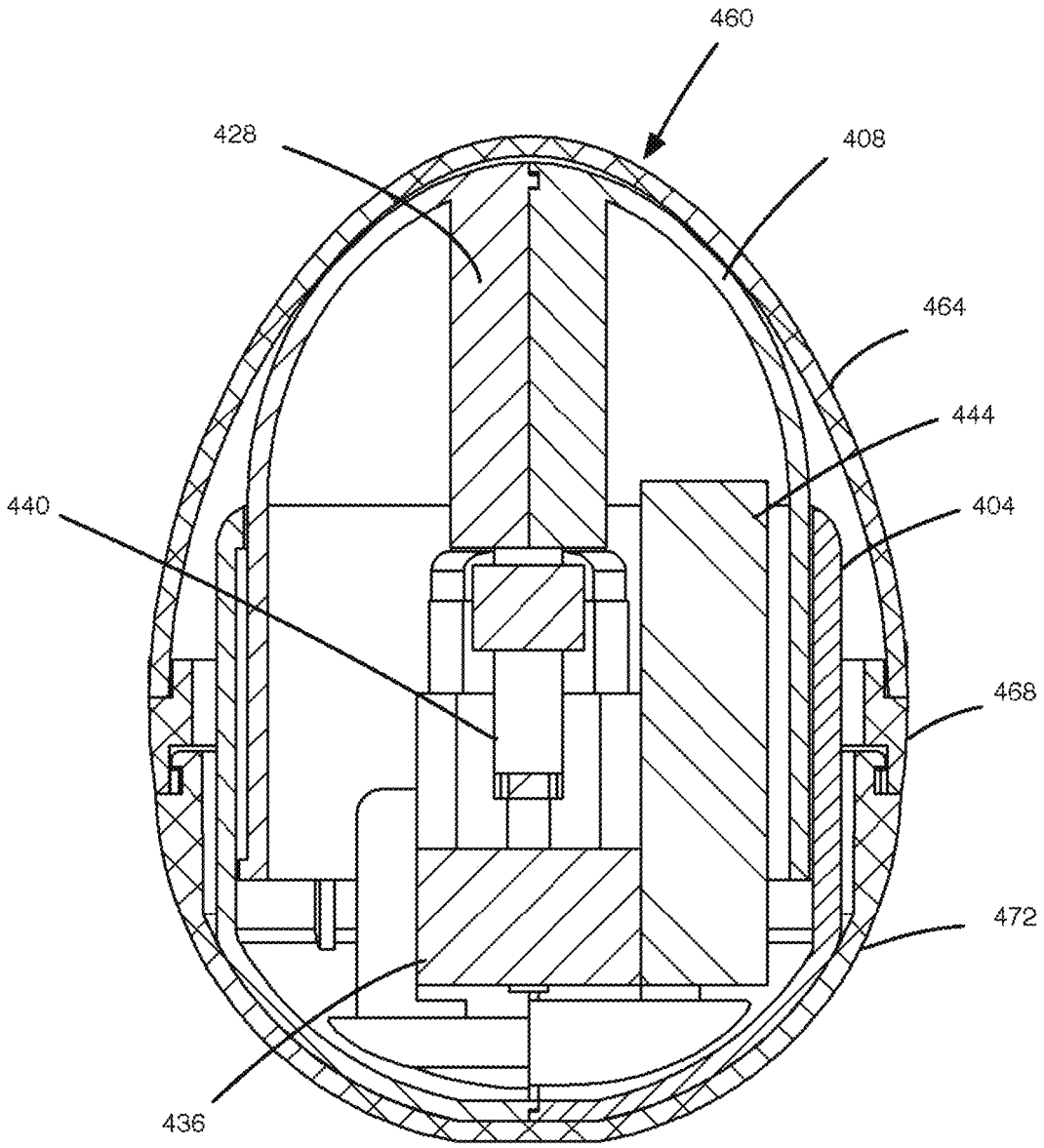
FIG. 25 is a side sectional view of the breakout mechanism of FIG. 24 inside a housing prior to activation of the breakout mechanism.

A biasing element, in particular a spring 332, is fitted inside of the tubular body 320 of the plunger member 316 and exerts a biasing force between the plunger member 316 and the base member 304. A collar 336 is mounted (e.g. via a thermal bond, adhesive, or any other suitable means) around the tubular body 320 of the plunger member 316 and prevents the full exit of the plunger member 316 from the base member 304 via abutment of the protrusion 328 against the collar 336. The spring 332 is in a compressed state between the rounded cap 324 of the plunger member 316 and the base wall of the base member 304 when the plunger member 316 is in a retracted position, in which the plunger member 316 within the base member 304, as shown in FIG. 25.

A release element, namely a wedge 340, is inserted into the slot 312 when the plunger member 316 is fully inserted into the base member 304, so as to hold the tubular body 320 of the plunger member 316 to one side of the interior of the base member 304 and positioning the protrusion 328 in the plunger locking recess 308. A ridge 344 along the wedge 340 limits insertion of the wedge 340 into the slot 312.

Figure 21:
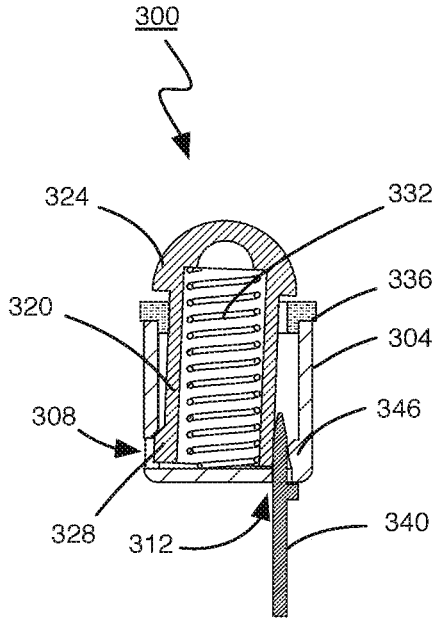
FIG. 21 is a side exploded view of the breakout mechanism of FIG. 20.

FIG. 21 shows the breakout mechanism 300 in a compacted state, wherein the plunger member 316 is in a retracted position within the base member 304 with the spring 332 in compression. The wedge 340 has been inserted into the slot 312, and is biased against the tubular body 320 by an internal protuberance 346 within the slot, urging the tubular body 320 of the plunger member 316 to one side of the interior of the base member 304 and the protrusion 328 into the recess 308 to inhibit biasing of the plunger member 316 by the spring 332.

The release element can, in some alternative embodiments, restrict expansion of the spring or other biasing element.

Figure 22:
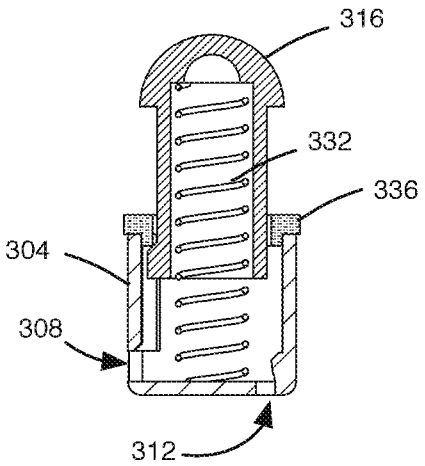
FIG. 22 is another sectional side view of the breakout mechanism of Figure after activation via release of the tab.

FIG. 22 shows the breakout mechanism in an expanded state. Removal of the wedge 340 enables the tubular body 320 of the plunger member 316 to shift within the base member 304, permitting the protrusion 328 to exit the plunger locking recess 308 and releasing the plunger member 316 to be moved outwardly from the base member 304 by the separating force of the spring 332.

The breakout mechanism 300 can form part of a toy character similar to the toy character 14. For example, the plunger member 316 and the base member 304 may together be included in the housing of the toy character. Thus, the plunger member 316 and the base member 304 may be configured as needed so that they contribute to the appearance of a young bird, reptile, or the like. Further, the breakout mechanism 300 can be placed within a housing, such as an egg, that may be fractured via the biasing force of the spring 332 urging the plunger member 316 outwardly toward an extended position (FIG. 22) relative to the base member 304. The housing has an aperture permitting the wedge 340 to be removed from the breakout mechanism 300. The spring 332 can exert a sufficiently strong biasing force to separate the plunger member 316 and the base member 304 and fracture a housing in which the breakout mechanism 300 is placed.

Figure 23:
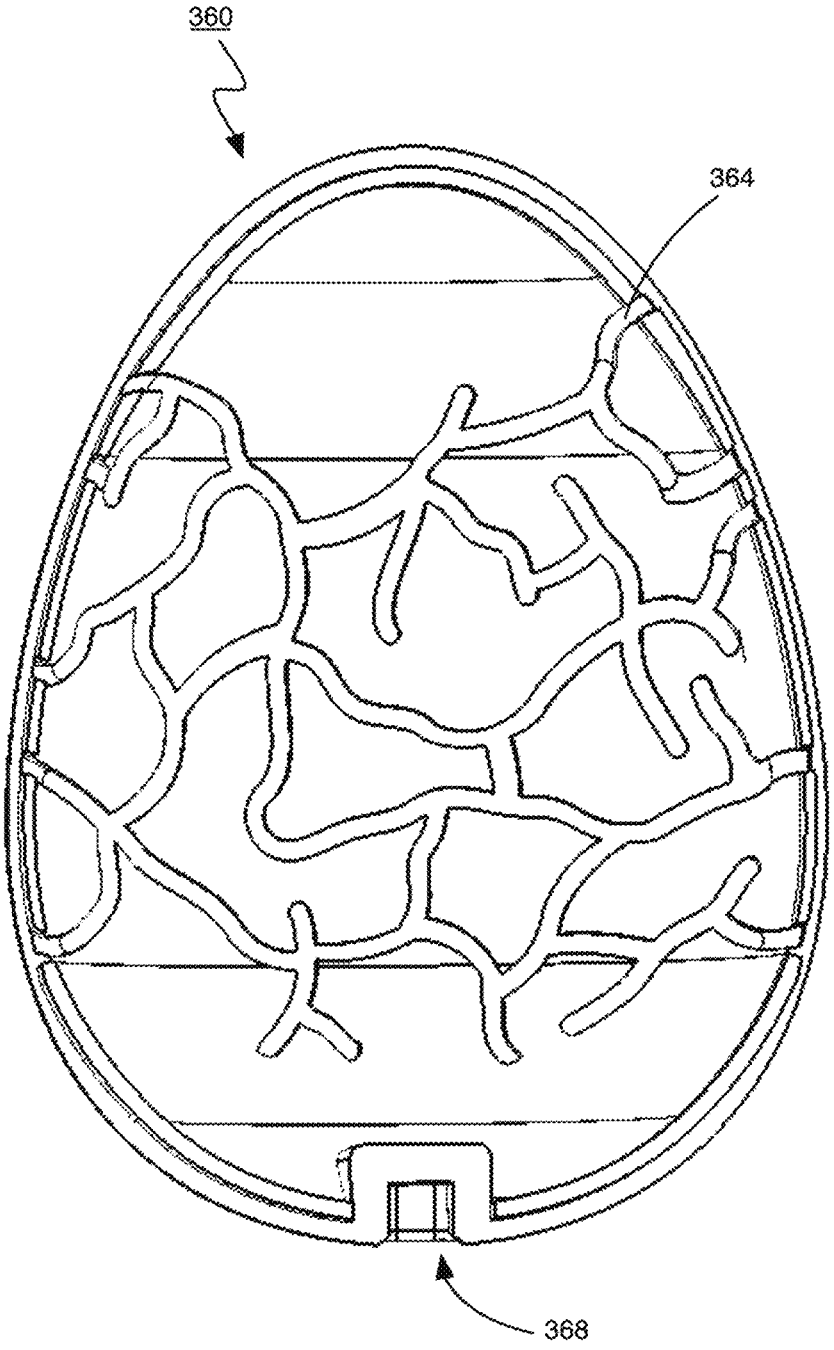
FIG. 23 is a side sectional view of a housing according to another non-limiting embodiment presented in the form of an egg shell having a plurality of continuous fracture paths formed therein.

FIG. 23 is a sectional view of a housing in which the breakout mechanism 300 of FIGS. 21 to 23 may be deployed. The housing in this example is in the form of an simulated egg shell 360 that has a series of fracture paths 364 formed along its interior, the fracture paths 364 having a decreased shell thickness relative to the surrounding portions of the egg shell 360. A wedge access aperture 368 in the egg shell 360 permits the pass-through of an end of the wedge 340 so as to permit a user to grasp the wedge 340 and remove it to activate the breakout mechanism 300.

Figure 24:
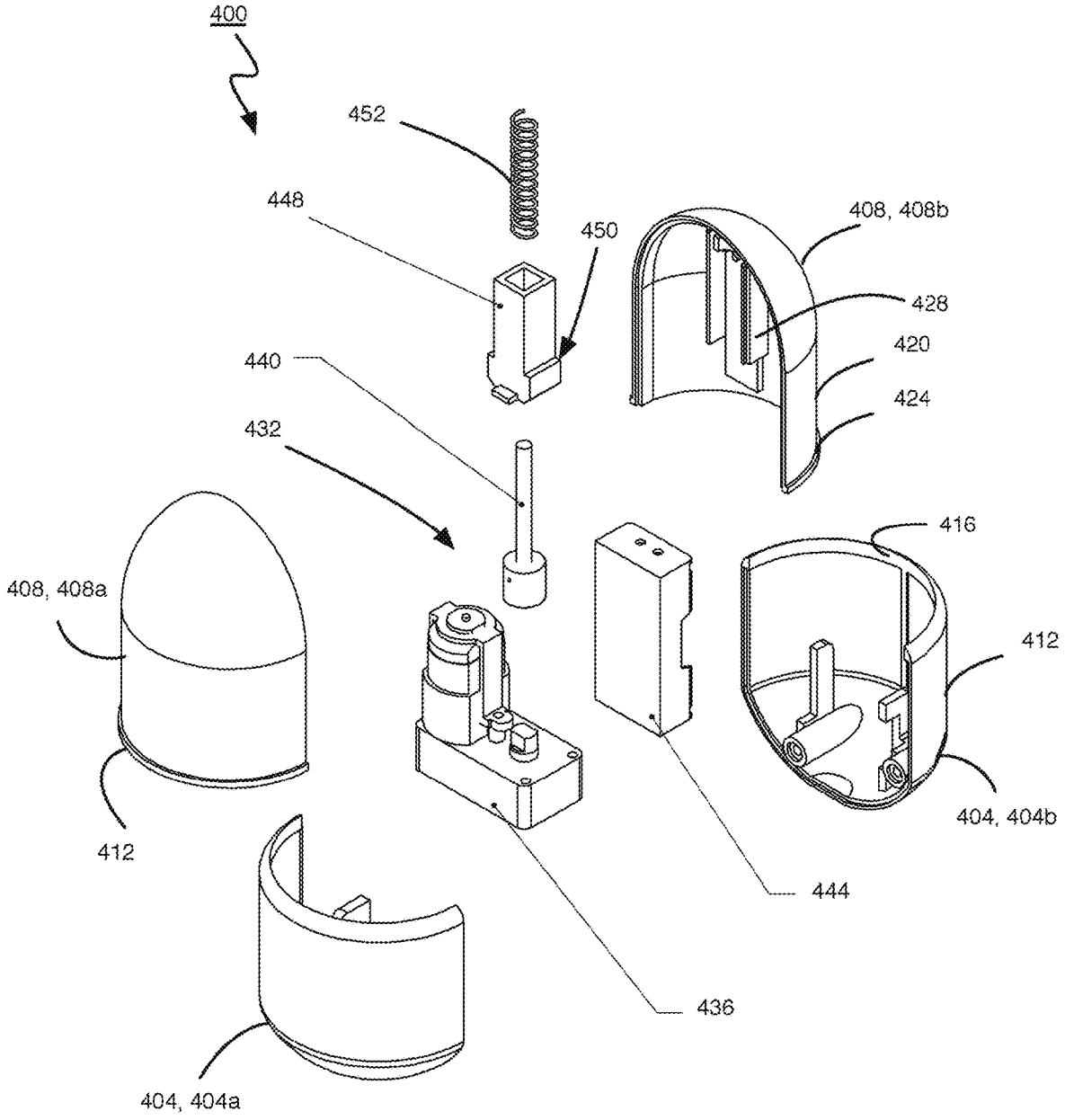
FIG. 24 is an exploded view of a number of components of another breakout mechanism forming part of a toy assembly according to a further non-limiting embodiment.

FIG. 24 illustrates a breakout mechanism 400 in accordance with another embodiment. The breakout mechanism 400 includes a base member 404 being formed of two base member portions 404*a*, 404*b*, and a plunger member 408 formed of two plunger member portions 408*a*, 408*b*. The base member 404 has a tubular side wall 412 with a generally hollow interior in which the plunger member 408 is received, and an interior lip 416 along the top of the side wall 412. The plunger member 408 has a tubular side wall 420, and an exterior ridge 424 along the bottom of the side wall 420 that cooperates with the interior lip 416 of the base member 404 to inhibit full exit of the plunger member 408 from the base member 404. The plunger member 408 also has a set of internal walls 428 that define a channel. A screw drive 432 is secured inside of the base member 404 and includes a motor 436 that turns a threaded shaft 440 (via a suitable mechanical drive will be easily configured by one skilled in the art based on the packaging requirements of the particular application), and a battery 444 for powering the motor 436. A traveler 448 having an internally threaded portion receives the threaded shaft 440. The traveler 448 is generally tubular and has a rectangular exterior profile dimensioned to prevent rotation in the channel defined by the internal walls 428 of the plunger member 408. A lip 450 on the exterior of the traveler 338 limits insertion into the channel defined by the internal walls 428 as it abuts against the lower edge of the internal walls 428. A biasing element 452 (which is shown as a helical compression spring and which, for convenience may be referred to as a spring 452) is fitted inside the end of the traveler 448 opposite the threaded shaft 440. A magnetic switch 453 is provided in the breakout mechanism 400 and controls power to the motor 436 from the battery 444. The magnetic switch 453 is actuatable (i.e. closed) by the presence of a magnet 454 proximate to the housing, as shown in FIG. 24, thereby powering the screw drive 432.

FIG. 25 shows the breakout mechanism 400 in a compacted state positioned inside a housing. In the illustrated embodiment, the housing is an egg shell 460. The egg shell 460 includes a fracturable shell portion 464 secured to an annular shell portion 468. The annular shell portion 468 snap-fits to a base shell portion 472. The traveler 448 is positioned inside the channel created by the internal walls 428 of the plunger member 408 and is positioned at a lower end of the threaded shaft 440. The spring 452 is compressed between a shoulder in the interior of the traveler 448 and an end surface in the channel. The motor 436 is used to drive the screw drive 432 to drive progressively increasing flexure of the spring 452 so as to increase a biasing force exerted by the spring 452 urging the plunger member 408 outward from the base member 404.

Figure 26:
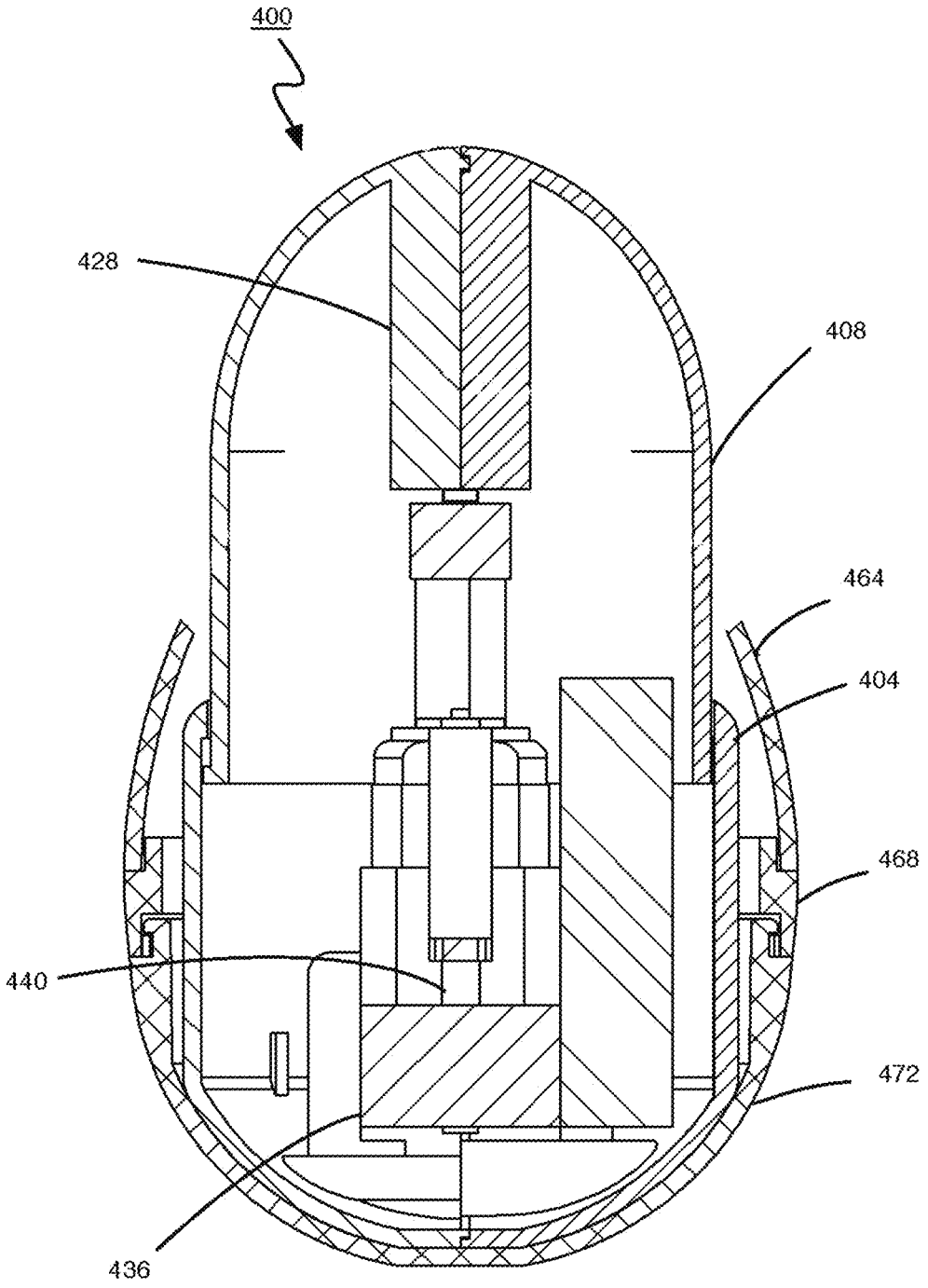
FIG. 26 is a side sectional view of the breakout mechanism of FIG. 25 protruding through the housing after activation.

FIG. 26 shows the breakout mechanism 400 in an expanded state after activation of the screw drive 432 via placement of a magnet proximate to the egg shell 460 adjacent the motor 436. The screw drive 432 operably exerts a separating force urging the plunger member 408 and the base member 404 apart. Upon sufficient fracturing of the egg shell 460, the spring 452 expands from a compressed state to push apart the broken egg shell 460 abruptly to heighten the realism of the hatching action.

Figure 27:
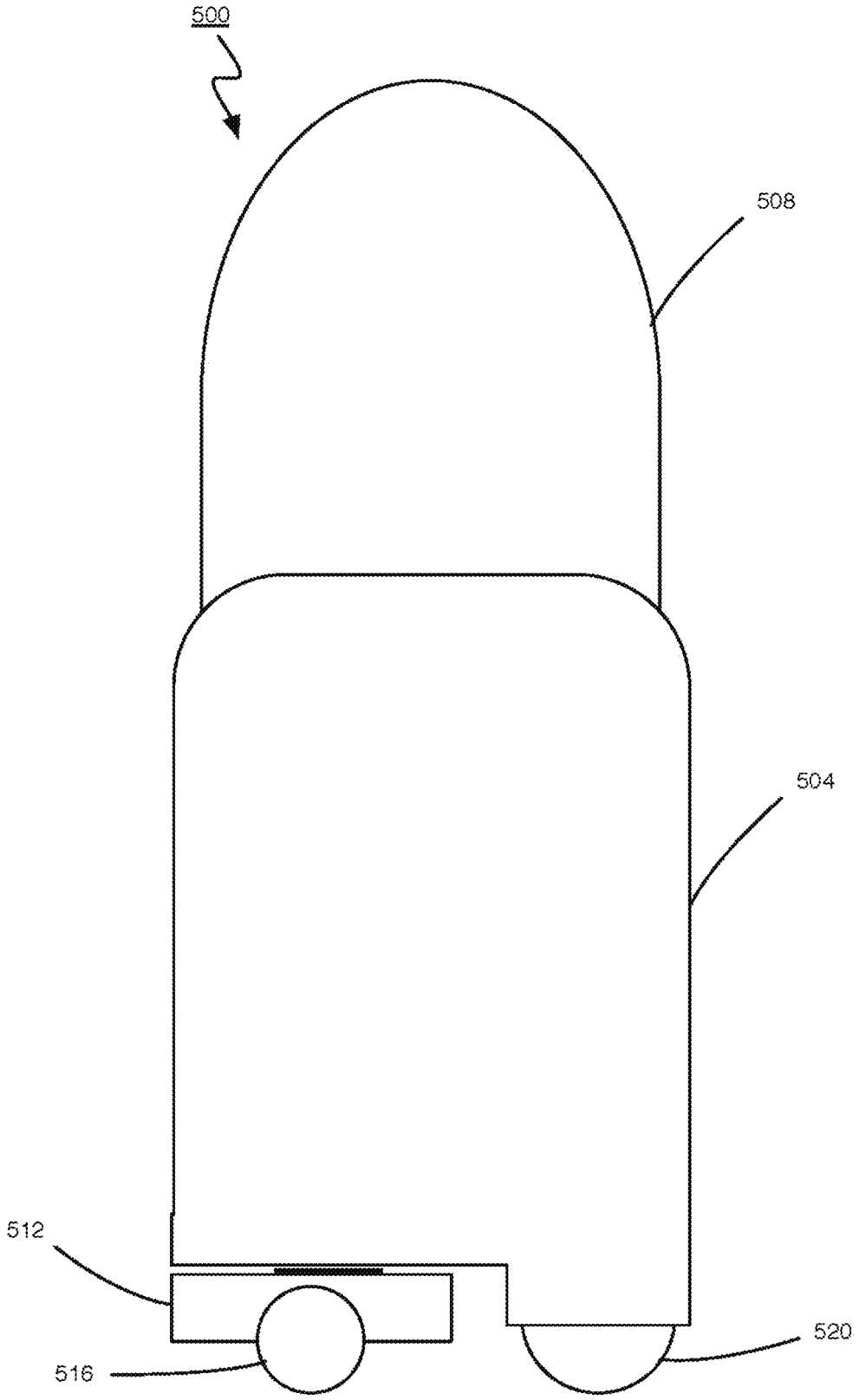
FIG. 27 is a side view of a breakout mechanism according to yet another non-limiting embodiment.

FIG. 27 shows a toy character 500 that includes a breakout mechanism similar to the breakout mechanism 400 shown in FIGS. 24 to 26. The breakout mechanism shown in FIG. 27 has a base member 504 and a plunger member 508 shown in an expanded state. The toy character 500 includes a swiveling wheel assembly 512 that has a pair of wheels 516 that are driven, optionally by the same motor that drives the base member 504 and the plunger member 508 apart. A pair of non-swivelling wheels 520 is attached to the base member 504. The swivelling wheel assembly may be connected to the motor in such a way that the wheel assembly 512 is intermittently rotated by some angle by the motor. This provides somewhat erratic movement to the breakout mechanism 500. This erratic movement can convey a sense of realism to the character during its movement.

Again, the breakout mechanisms described and illustrated herein may be provided a decorative cover to simulate the appearance of any suitable character.

Figure 28:
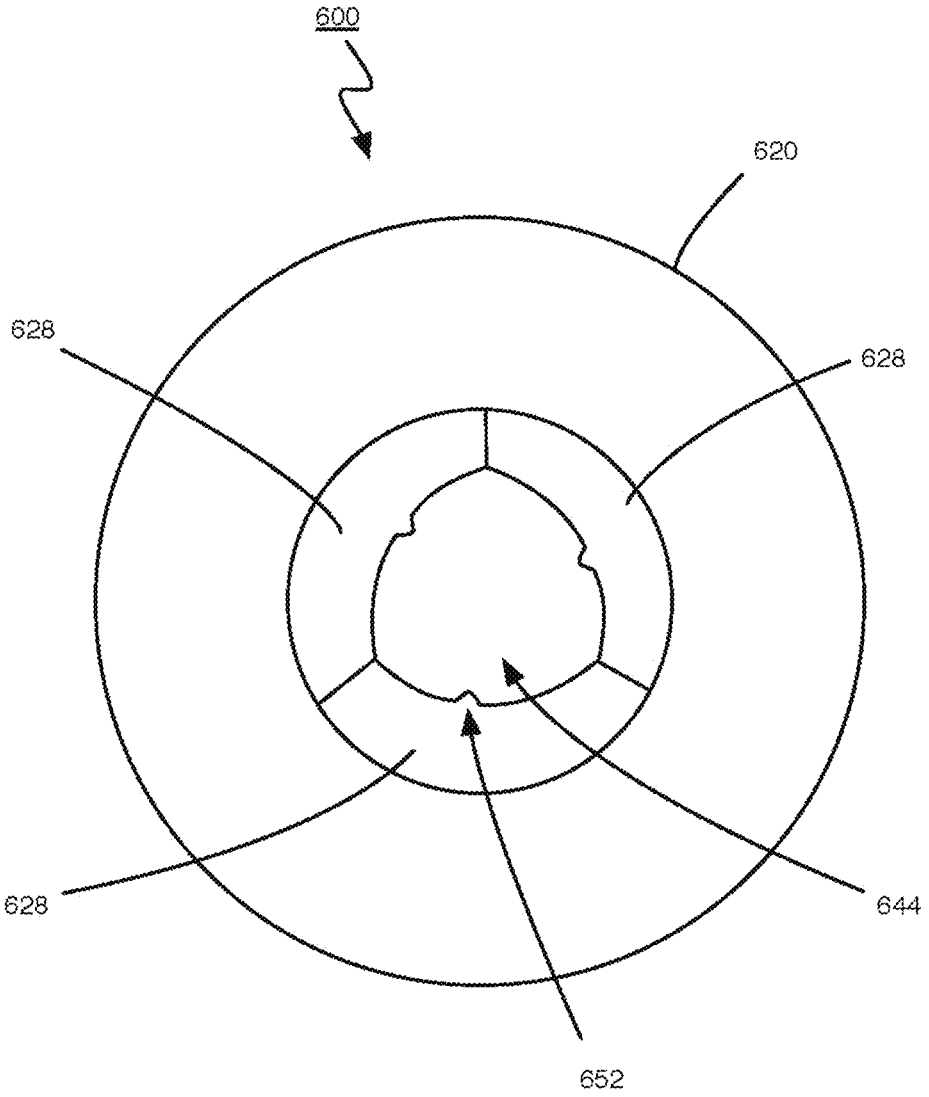
FIG. 28 is a top view of a housing fracturing mechanism according to a further non-limiting embodiment.
Figure 29:
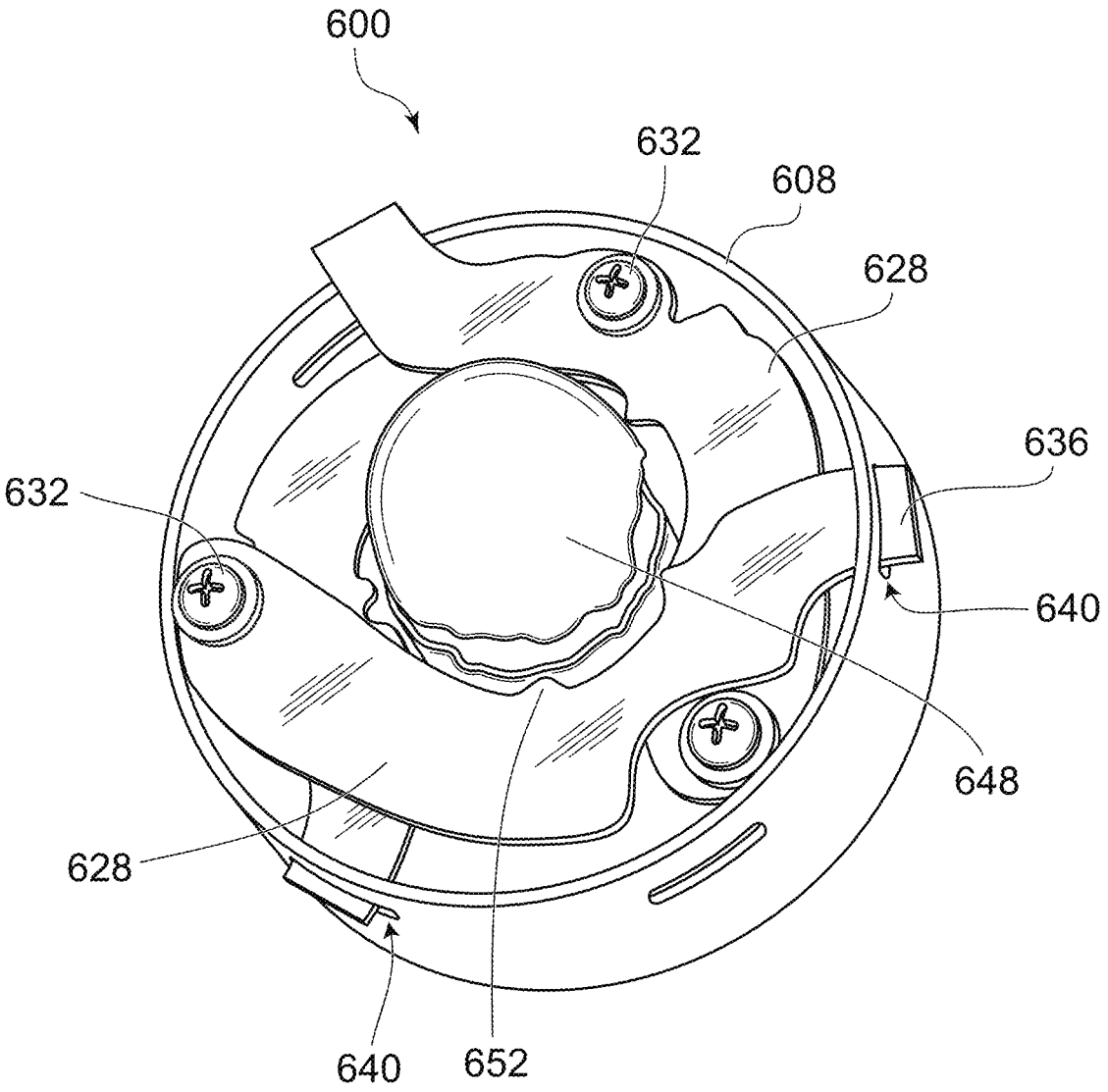
FIG. 29 is a top sectional view of the housing fracturing mechanism of FIG. 28 showing a housing being fractured.
Figure 30:
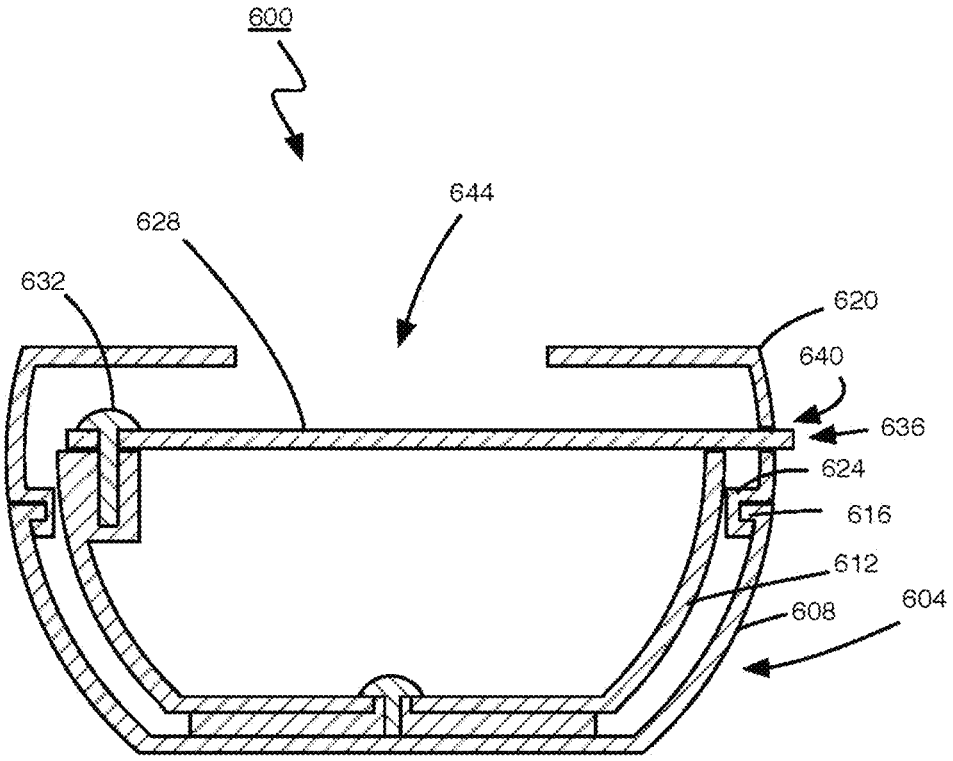
FIG. 30 is a side sectional view of the housing fracturing mechanism of FIG. 28.

FIGS. 28 to 30 illustrate a housing fracturing mechanism 600 according to an embodiment. The housing fracturing mechanism 600 has a base frame member 604 that includes an outer bowl 608 secured to an inner bowl 612. The outer bowl 608 has an inner lip 616 about its top periphery. An upper frame member 620 is rotatably coupled to the base frame member 604 about the top periphery of the outer bowl 608. An inner lip 624 of the upper frame member 620 securely receives the inner lip 616 of the outer bowl 608. Three cutting elements 628 are pivotally coupled at a first end thereof to the base frame member 604 via a fastener such as a partially threaded screw 632. A second end 636 of the cutting elements 628 is slidably coupled to the upper frame member 620 via their protrusion through openings 640 in a side wall of the upper frame member 620. The cutting elements 628 are somewhat arcuate in shape and define an aperture 644 into which a housing 648 to be fractured may be positioned.

As will be understood, rotation of the upper frame member 620 in a counter-clockwise direction relative to the base frame member 604 causes the cutting elements 628 to pivot and intersect/constrict the aperture 644 like an analog camera aperture. Sharp protrusions 652 along the cutting elements 628 project towards the aperture 644 and act to puncture and/or crack the housing 648. In this manner, the housing 648 placed in the housing fracturing mechanism 600 may be fractured.

As will be understood, the cutting elements can be slidably connected to the upper frame member via a number of ways, such as by having a channel therein into which is secured a fastener fastened to the upper frame member. Further, the cutting elements may be pivotally connected to the upper frame member and slidably connected to the base frame member.

One or more cutting elements can be employed and can act to compress the housing to be fractured against other cutting elements or against a portion of the frames.

Figure 31A:
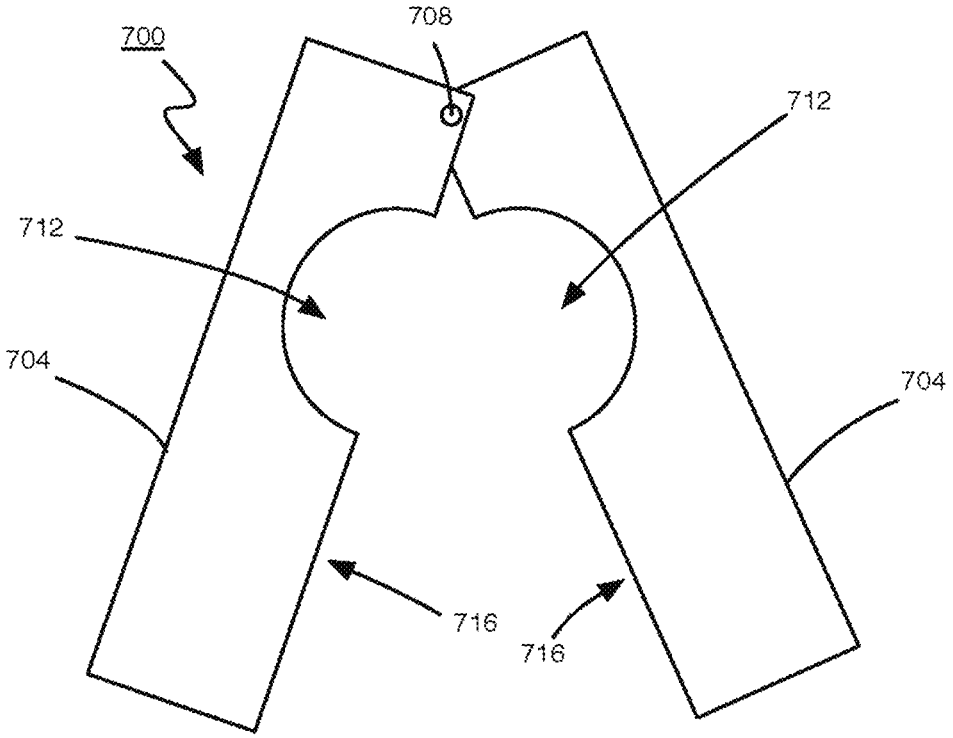
FIG. 31A is a top view of a housing fracturing mechanism according to yet another non-limiting embodiment having two pivotally-connected members.
Figure 31B:
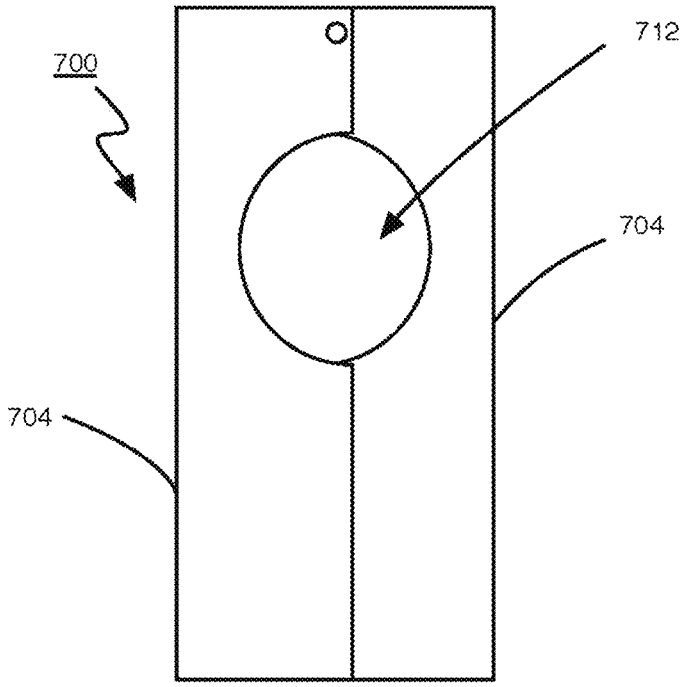
FIG. 31B is a top view of the housing fracturing mechanism of FIG. 31A wherein the two members have been pivoted relative to one another to restrict an aperture defined by the two members.

FIGS. 31A and 31B illustrate a housing fracturing mechanism 700 in accordance with another embodiment. The housing fracturing mechanism 700 includes a pair of cutting elements 704 that are pivotally coupled via a fastener 708, such as a bolt or rivet. One or both of the cutting elements 704 has a recess 712 in a cutting edge 716 thereof. A housing to be broken can be placed in the one or more recesses 712 and can be broken via pivoting of the cutting elements 704, as shown in FIG. 31B, thereby permitting access to the toy character provided in the housing.

Toy characters employing the breakout mechanisms described above, particularly those illustrated in FIGS. 20 to 23 and 24 to 27, can be used in conjunction with companion toy characters that may or may not be placed inside a housing with the toy characters.

Figure 32A:
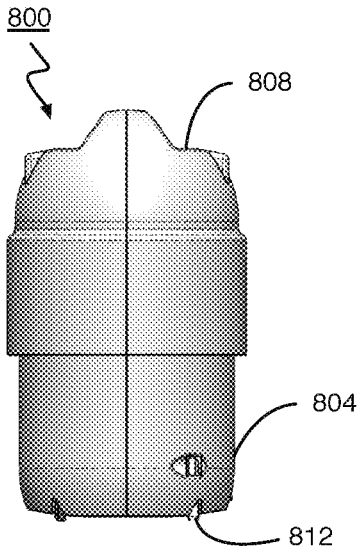
FIG. 32A is a front view of a breakout mechanism in accordance with another embodiment in an expanded state.

FIG. 32A shows a breakout mechanism 800 for a toy character similar to that of FIG. 27 in an expanded state. The breakout mechanism 800 has a base member 804 that nests within a plunger member 808 in a compacted state and is urged away from the plunger member 808 via a screw drive having a motor to the expanded state shown. Movement of the toy character on a surface is provided by wheels 812 that have a cam profile on them with at least one lobe on each wheel, similar to those shown in FIG. 6). The wheels 812 are driven by the motor.

Figure 32B:
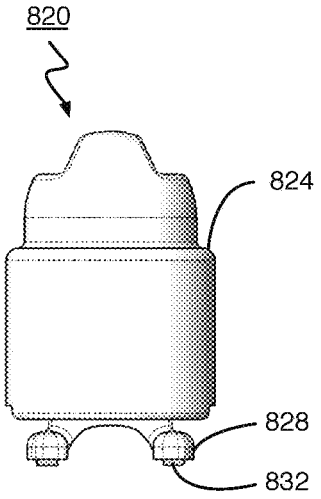
FIG. 32B is a front view of a companion mechanism for placement in a housing with the breakout mechanism of FIG. 32A.

FIG. 32B shows a companion mechanism 820 for a companion toy character that is placed in a housing with the toy character (employing the breakout mechanism 800 of FIG. 32A). The companion mechanism 820 has a main body 824 and a wheel base 828 that nests within the main body 824, but is biased outwards via an internal helical metal coil spring to an expanded state as shown. The wheel base 828 has a set of wheels 832 enabling movement of the companion mechanism 820 along a surface with minimal pushing.

Figure 33:
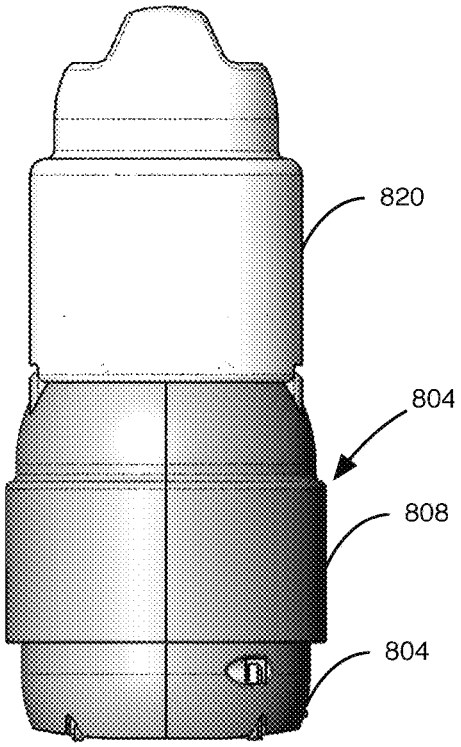
FIG. 33 shows the breakout mechanism of FIG. 32A and the companion mechanism of FIG. 32B in a stacked compacted state.

FIG. 33 shows the breakout mechanism 800 of FIG. 32A and the companion mechanism 820 of FIG. 32B in a stacked compacted state. In the compacted state, the screw drive of the breakout mechanism 800 has not yet been activated to drive the plunger member 808 away from the base member 804. The companion mechanism 820 is also in a compacted state, with the wheel base 828 being held under compression within the main body 824 against the force of the helical metal coil spring. The companion mechanism 820 is atop the plunger member 808 of the breakout mechanism 800.

Figure 34:
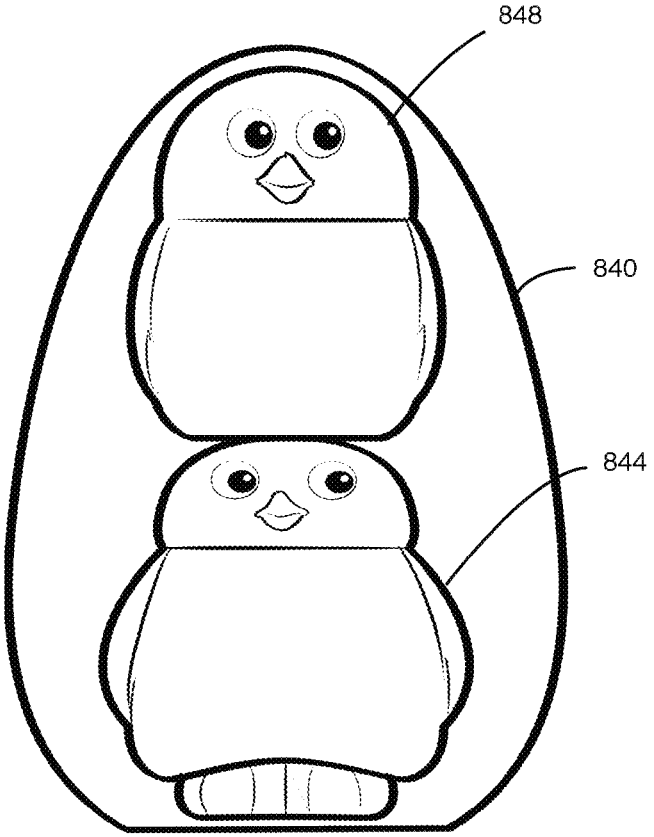
FIG. 34 is a sectional view of a housing in the form of an egg having two toy characters employing a breakout mechanism similar to that of FIG. 32A and a companion mechanism similar to that of FIG. 32B respectively.

FIG. 34 is a sectional view of a housing in the form of an egg shell 840 having two toy characters positioned inside. A primary toy character 844 employs the breakout mechanism 800, which is in a compacted state. A ancillary toy character 848 employs the companion mechanism 820, which is also in a compacted state. Upon activation of the motor and attached screw drive of the breakout mechanism 800 within the primary toy character 844, such as via a magnet to draw two contacts together to close a circuit, the screw drive urges the plunger member 808 away from the base member 804, causing the breakout mechanism 800 to expand and push the ancillary toy character 848 through the egg shell 840 to fracture it. At the same time, the wheels 812 commence to rotate, and their lobes help push against the interior of the egg shell 840 to fracture it.

Upon its fracturing, the companion mechanism 820 within the toy character 848 is no longer held in compression and the wheel base 828 is urged away from the main body 824 by the helical metal coil spring.

Once the primary toy character 844 is freed from the egg shell 840, the wheels 812 cause the primary toy character 844 to move across a surface upon which it is placed.

The breakout mechanism 800 and the companion mechanism 820 can include electronic components that are activated upon expansion. In the case of the breakout mechanism 800, the electronic components can be placed on the same circuit as the motor and be activated upon closing of the circuit. For the companion mechanism 820, its electronic components may be activated upon the closing of a circuit once the main body 824 and the wheel base 828 are urged apart by the helical metal coil spring.

The electronic components can enable the primary toy character 844 and the ancillary toy character 848 to make audible noises such as bird chirps, display lights, etc. Further, the primary toy character 844 and the ancillary toy character 848 can "interact" through sensing the other. For example, the primary toy character 844 can be equipped with an audio speaker for generating a bird chirping noise, and the ancillary toy character 848 can be equipped with an audio sensor (i.e. a microphone), a processor to discern the bird chirping noise from other audio signals, and an audio speaker to output a corresponding higher-pitched bird chirp. Both the primary toy character 844 and the ancillary toy character 848 can be equipped with sensors, such as microphones, light detectors, network antennas, etc., processors, and output devices, such as audio speakers, light emitting diodes, network radios, etc. In this manner, the primary toy character 844 and the ancillary toy character 848 can interact, with one setting off the other.

In one embodiment, the audio and/or light signals output by an ancillary toy character can be received and used by a primary toy character to locate and move to the ancillary toy character.

Figure 35:
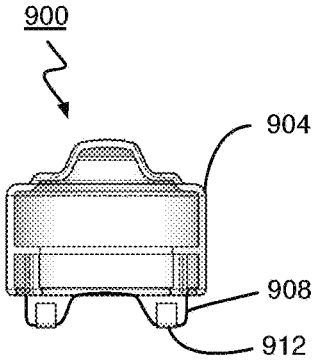
FIG. 35 is a front cross section view of a smaller companion mechanism than that of FIG. 32B for placement in a housing with a breakout mechanism such as that of FIG. 32A.

FIG. 35 shows another companion mechanism 900 for a smaller ancillary toy character similar to the companion mechanism 820 of FIG. 32B in accordance with another embodiment. The companion mechanism 900 has a main body 904 and a wheel base 908 that nests within the main body 904, and that is biased outwards via an internal helical metal coil spring to an expanded state as shown. The wheel base 908 has a set of wheels 912 enabling movement of the companion mechanism 900 along a surface with minimal pushing.

Figure 36:
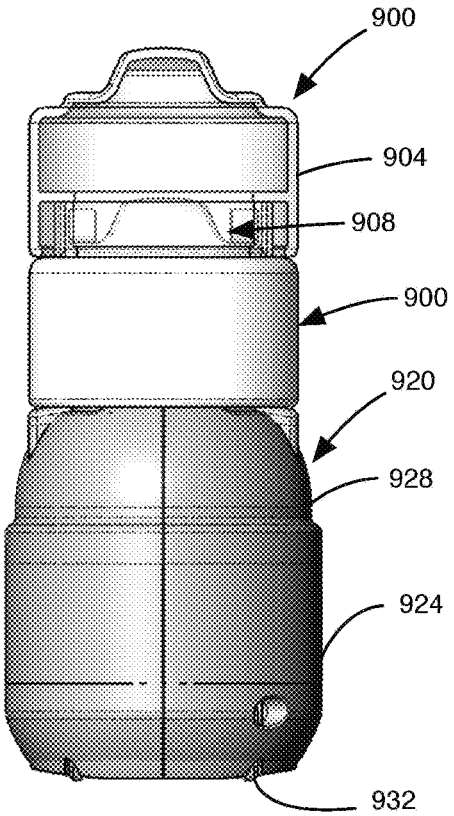
FIG. 36 is a partial sectional front view of a breakout mechanism similar to that of FIG. 32A and two of the companion mechanisms of FIG. 35 in a stacked compacted state.

FIG. 36 shows a breakout mechanism 920 similar to that of FIG. 32A and two of the companion mechanisms 900 of FIG. 35 in a stacked compacted state. The breakout mechanism 920 has a base member 924 that nests within a plunger member 928 in a compacted state as shown, and is urged away from the plunger member 928 to an expanded state via a screw drive. Movement of the breakout mechanism 920 on a surface is provided by wheels 932 that have a cam profile on them with at least one lobe on each wheel, similar to those shown in FIG. 6).

Each of the two companion mechanisms 900 has its wheel base 908 being held under compression within the main body 904 against the force of the helical metal coil spring. One of the companion mechanisms 900 is positioned atop of the other companion mechanism 900, which is, in turn, positioned atop the plunger member 928 of the breakout mechanism 920.

Figure 37:
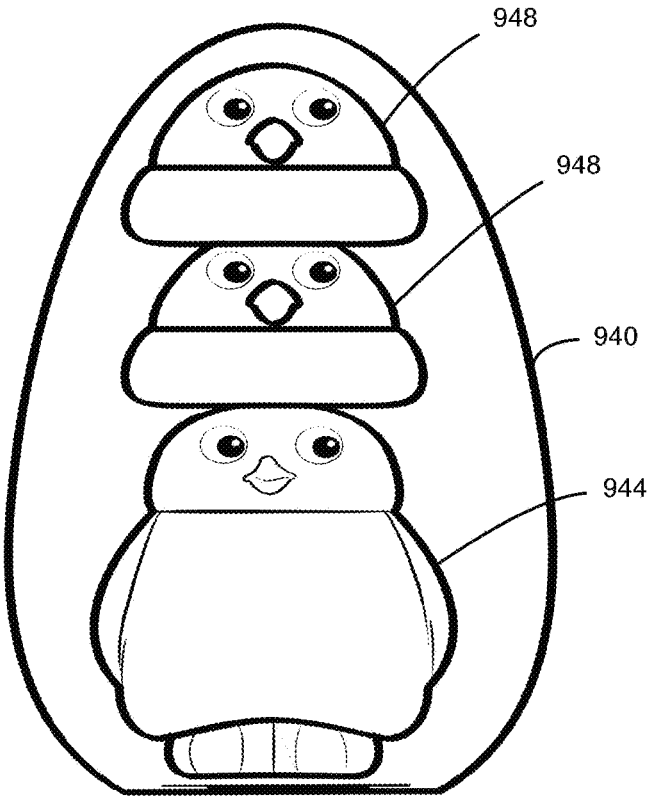
FIG. 37 is a sectional view of a housing in the form of an egg having three toy characters employing a breakout mechanism similar to that of FIG. 32A and two companion mechanisms as shown in FIG. 36 respectively.

FIG. 37 is a sectional view of a housing in the form of an egg shell 940 having three toy characters positioned inside. A primary toy character 944 employs the breakout mechanism 920, which is in a compacted state. Each of two ancillary toy characters 948 employ the companion mechanism 900, which is also in a compacted state. Upon activation of the screw drive of the breakout mechanism 920 within the primary toy character 944, such as via a magnet to draw two contacts together to close a circuit, the screw drive urges the plunger member 928 away from the base member 924, causing the breakout mechanism 920 of the primary toy character 944 to expand and push the toy characters 948 positioned on top through the egg shell 940 to fracture it. Upon its fracturing, the companion mechanism 900 within each of the ancillary toy characters 948 is no longer held in compression and the wheel base 908 is urged away from the main body 904 by the helical metal coil spring.

The primary toy character 944 and the ancillary toy characters 948 can include electronic componentry to provide additional functionality as described above with regards to the primary toy character 844 and the ancillary toy character 848.

A breakout mechanism can be configured with one or more additional behaviors when the breakout mechanism is placed back in a housing. For example, the breakout mechanism may move, emit audible noises, light up, etc.

Figure 38:
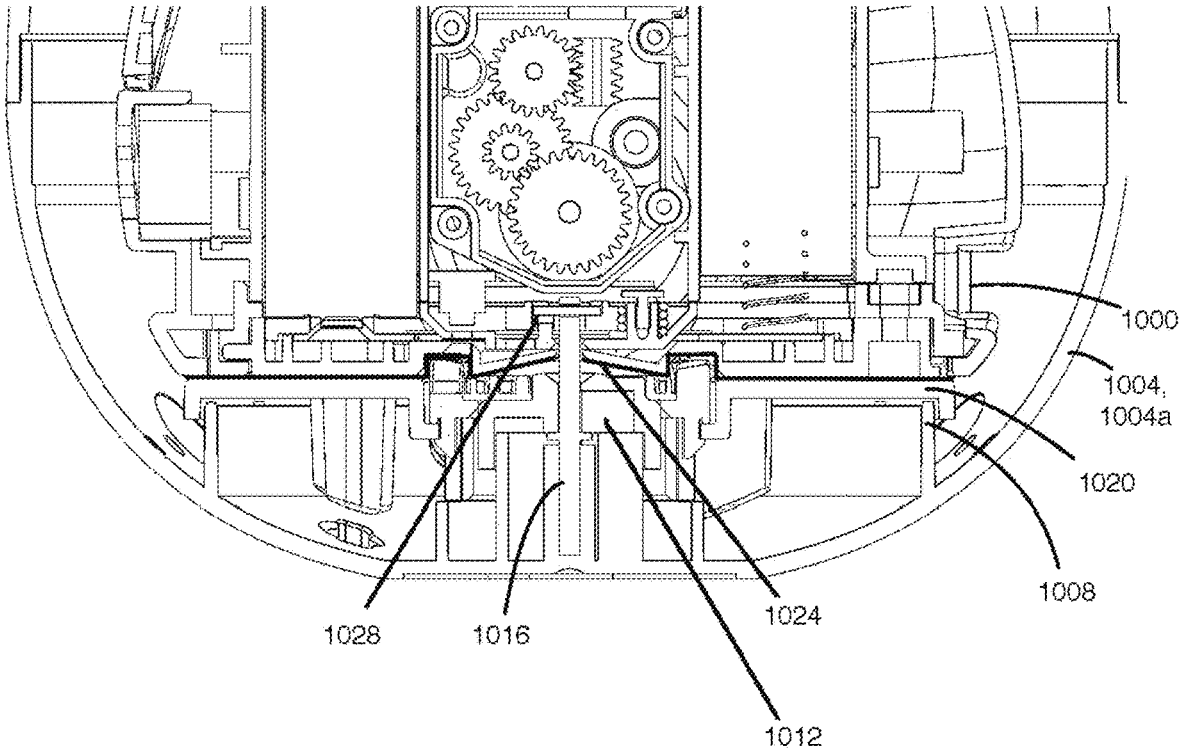
FIG. 38 is a partial sectional view of a housing, an adapter disk, and a breakout mechanism in accordance with yet another embodiment.

FIG. 38 shows an exemplary breakout mechanism 1000 that is configured with additional behaviors when placed in a housing. The housing is an egg shell 1004 that has a raised inner ring 1008. A small magnet 1012 magnetizes a metal rod 1016 that protrudes from the centre of the bottom inside surface of the egg shell 1004. An adapter disk 1020 is positioned atop of the raised inner ring 1008 of the egg shell 1004. The adapter disk 1020 snaps onto the breakout mechanism 1000 and enables movement of the breakout mechanism 1000 relative to the egg shell 1004 as part of an additional behavior. A frustoconical metal disk 1024 is secured to the bottom of the breakout mechanism 1000 to guide placement of the metal rod 1016 to a Hall sensor 1028 inside of the breakout mechanism 1000. The Hall sensor 1028 senses the magnetism of the metal rod 1016 to detect when the breakout mechanism 1000 is positioned inside of the egg shell 1004.

Figure 39:
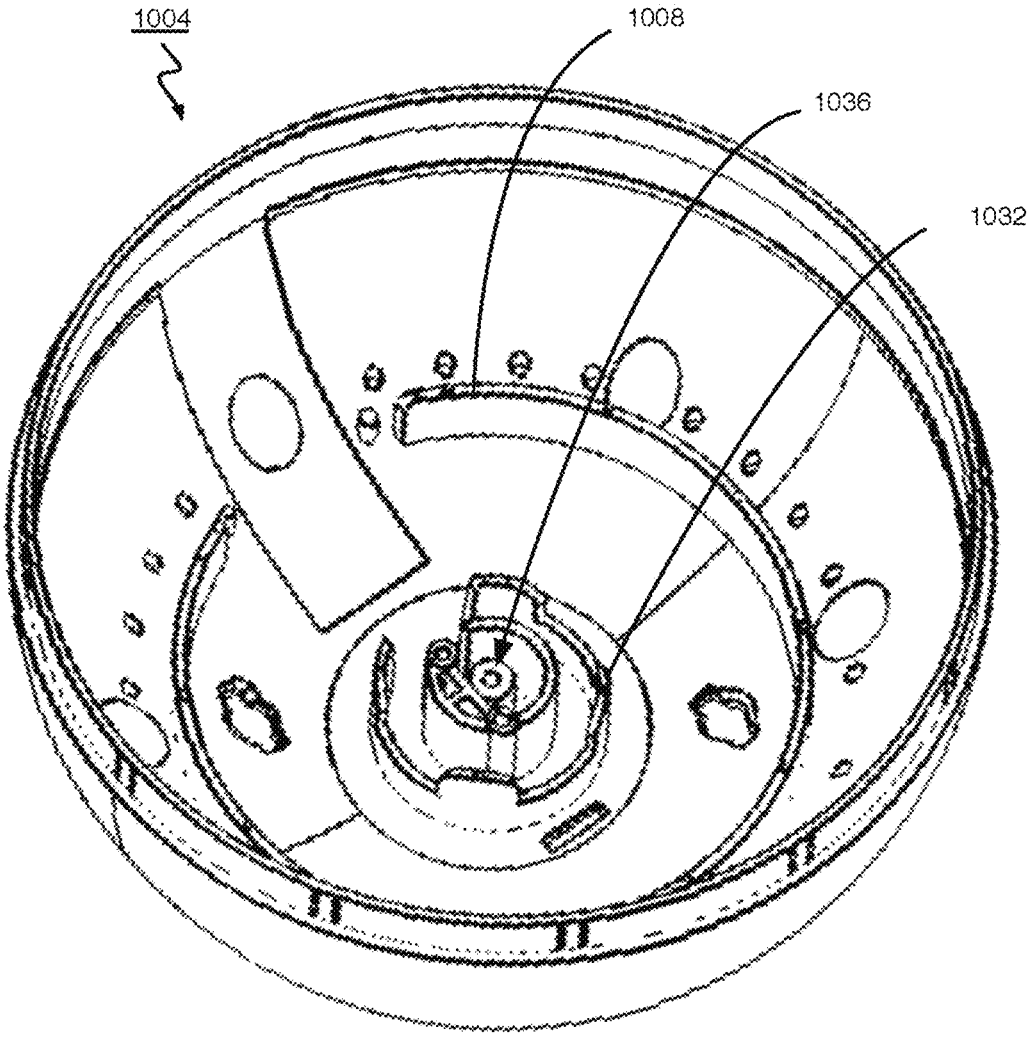
FIG. 39 is a top perspective view of a bottom portion of the housing of FIG. 38.

FIG. 39 shows a bottom portion of the egg shell 1004 with the raised inner ring 1008 along its inside surface. A crenelated ring 1032 protrudes from the interior surface of the bottom of the egg shell 1004 within the raised inner ring 1008. A post anchor 1036 inside of the crenelated ring 1032 has an aperture in which the metal rod 1016 is secured.

Figure 40A:
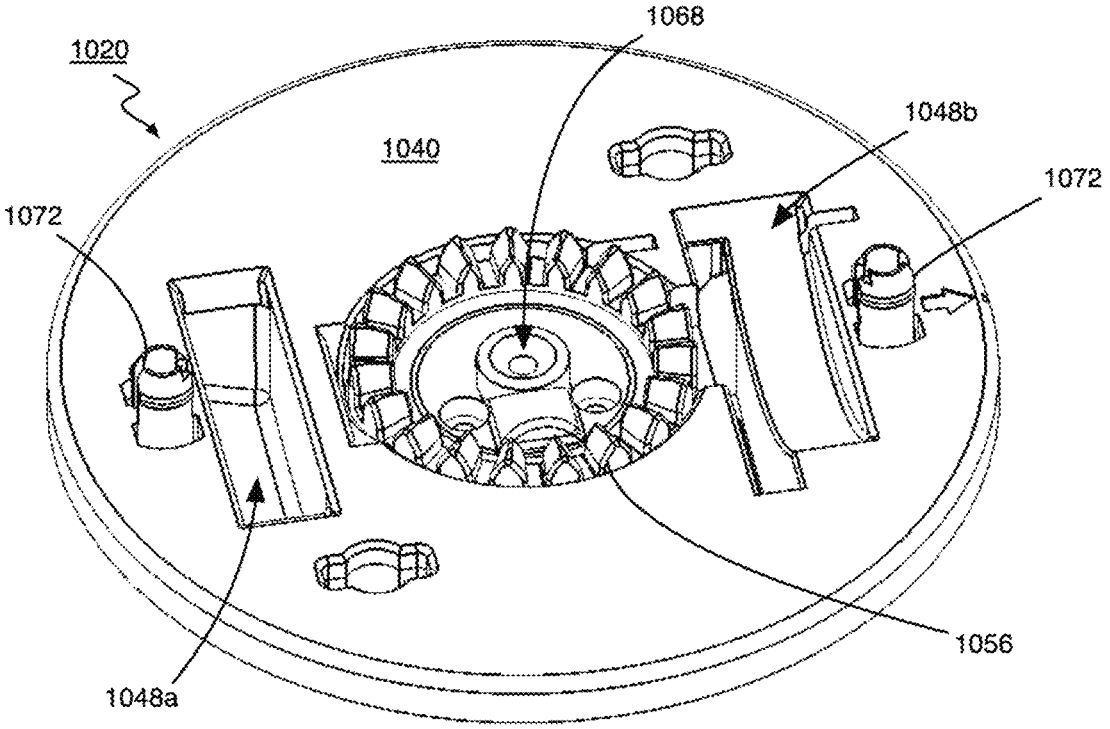
FIG. 40A is a top perspective view of the adapter disk of FIG. 38.
Figure 40B:
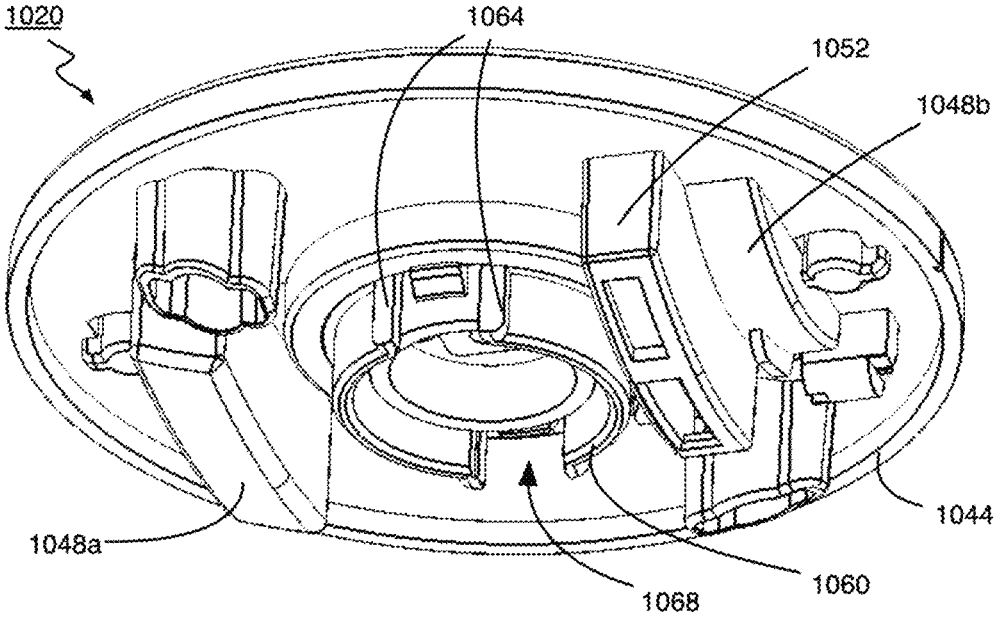
FIG. 40B is a bottom perspective view of the adapter disk of FIG. 38.

FIGS. 40A and 40B show the adapter disk 1020 having an annular plate 1040 with a peripheral lip 1044 extending downwards. A pair of wheel recesses 1048*a*, 1048*b* are dimensioned to receive wheels of the breakout mechanism 1000. One of the wheel recesses, 1048*a*, is deeper than required to receive a wheel of the breakout mechanism 1000. A disk grip 1052 projects from a bottom surface of the annular plate 1040. Together, the wheel recess 1048*a* and the disk grip 1052 enable a person to pull the adapter disk 1020 off of the breakout mechanism 1000 onto which it snaps so that the wheels of the breakout mechanism 1000 may be exposed and used to mobilize the breakout mechanism 1000 on a surface. A central gear disk 1056 is rotatably coupled to the annular plate 1040 and has a number of gear teeth on its upper surface. Two arcuate walls 1060 extend from a lower surface of the central gear disk 1056. The arcuate walls 1060 have thickened vertical edges 1064. A through-hole 1068 enables passage of the metal rod 1016 through the adapter disk 1020. A pair of securement posts 1072 extend from the upper surface of the annular plate 1040 to releasably engage corresponding holes in the bottom surface of the breakout mechanism 1000.

The breakout mechanism 1000 is configured such that, prior to its triggering to fracture the egg shell 1004, detection of the magnetism of the metal rod 1016 does not trigger the motor of the breakout mechanism 1000. To trigger the additional behaviors of the breakout mechanism 1000 thereafter, the adapter disk 1020 is secured to the bottom of the breakout mechanism 1000 via the securement posts 1072, and the combined breakout mechanism 1000 and adapter disk 1020 are placed into the bottom portion of the egg shell 1004. The arcuate walls 1060 of the adapter disk 1020 fit within the crenelated ring 1032 of the egg shell 1004, and the thickened vertical edges 1064 engage the crenelated ring 1032 to inhibit rotation of the central gear disk 1056 relative to the egg shell 1004.

During placement of the breakout mechanism 1000 and the adapter disk 1020, the metal rod 1016 inserts into the breakout mechanism 1000 guided by the frustoconical metal disk 1024 so that the metal rod 1016 engages the Hall sensor 1028. The magnetism of the metal rod 1016 is sensed by the Hall sensor 1028 and triggers the motor of the breakout mechanism 1000 to start up.

The breakout mechanism 1000 includes an angled piston arm coupled to the motor that projects from its bottom surface. The motor drives the angled piston arm cycles between extending angularly below the bottom surface of the breakout mechanism 1000 and retracting back into it by its off-center attachment to a rotating disk driven by the motor. On its downward stroke, the angled piston arm engages the gear teeth on the upper surface of the central gear disk 1056 to rotate the breakout mechanism 1000 and annular plate 1040 secured thereto relative to the central gear disk 1056. On the upward stroke of the angled piston arm, the breakout mechanism 1000 and the annular plate 1040 secured to it remain stationary relative to the egg shell 1004. As will be understood, continued operation of the motor of the breakout mechanism 1000 causes it to intermittently rotate within the egg shell 1004.

The motor of the breakout mechanism 1000 can also drive other mechanisms, such as the rotation of extending wing members, providing the illusion that the breakout mechanism 1000 is flapping its wings.

In addition, the Hall sensor 1028 may trigger other elements of the breakout mechanism 1000. For example, the breakout mechanism 1000 can include one or more of lights, an audio speaker emitting a bird chirp, etc. that can be triggered by the Hall sensor 1028.

Other types of sensors and mechanisms can be used in place of the Hall sensor to trigger the additional behaviors. For example, the metal rod may complete an electrical circuit to drive the motor when inserted into the breakout mechanism. In a further example, a rod can urge two metal contacts into contact to complete a circuit to drive the motor when inserted into the breakout mechanism.

Movement of the breakout mechanism relative to the housing can be achieved in other manners. For example, a circular track on the inside of the housing can enable the rotation of one wheel to rotate the breakout mechanism relative to the housing.

The dimensions and shape of the recesses, and the materials of the cutting elements can be varied to accommodate housing shapes, materials, and dimensions.

The breakout mechanism and companion mechanisms can be provided with one or more switches to modify their behavior. The switches can take the form of buttons, physical switches, etc. and can include audio sensors, optical/motion sensors, magnetic sensors, electrical sensors, heat sensors, etc.

In the figures, a toy character has been shown as being provided in the housing. However, it will be noted that the toy character is but one example of an inner object that is provided in the housing. In some embodiments described herein, the inner object may be animate and may include a breakout mechanism. In some embodiments the inner object may not be animate. In some embodiments the inner object may be animate but may not itself include a breakout mechanism. In some embodiments the inner object may be a toy character. In some embodiments, the inner object may not be a character in the sense that it may not be configured to appear as a sentient entity.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A toy assembly, comprising:

a housing;

an inner object inside the housing, wherein the inner object includes a breakout member that is operable to break the housing to expose the inner object, wherein the inner object includes a drive wheel and a drive tooth;

a bushing platform that releasably holds the inner object and which is rotatably mounted to the housing;

a rotation mechanism configured to rotate the inner object in the housing, wherein the rotation mechanism includes a stationary gear that is fixedly mounted to the housing; and a motor in the inner object that is operatively connected to the drive wheel and to the drive tooth such that operation of the motor drives rotation of the drive wheel and the drive tooth, wherein the drive tooth is positioned to engage the stationary gear periodically during rotation of the drive tooth in order to rotationally index the inner object and the breakout member by a selected amount, for subsequent actuation of the breakout member so as to open the housing.

2. A toy assembly as claimed in claim 1, wherein the motor is operatively connected to the breakout member such that further rotation of the motor after indexing of the inner object and the breakout member drives the breakout member to break the housing so as to open the housing.

3. A toy assembly as claimed in claim 2, wherein the breakout member is a hammer and wherein the motor is operatively connected to the breakout member such that further rotation of the motor after indexing of the inner object and the breakout member drives retraction of the hammer to a retracted position and subsequent release of the hammer to engage and break the housing.

4. A toy assembly as claimed in claim 1, wherein the housing is in the form of an egg.

5. A toy assembly as claimed in claim 4, wherein the inner object is in the form of a bird.

6. A toy assembly as claimed in claim 1, wherein the inner object is removable from the housing after actuation of the breakout member to break the housing, and positionable on a support surface such that rotation of the motor while the inner object is on the support surface drives rotation of the drive wheel so as to propel the inner object on the support surface.

* * * * *